US007821186B2

(12) United States Patent
Kameda et al.

(10) Patent No.: US 7,821,186 B2
(45) Date of Patent: Oct. 26, 2010

(54) SPARK PLUG HAVING SPECIFIC CONFIGURATION OF CENTER ELECTRODE WITH RESPECT TO OUTER ELECTRODE

(75) Inventors: Hiroyuki Kameda, Aichi (JP); Katsutoshi Nakayama, Nagoya (JP); Satoshi Nagasawa, Nagoya (JP); Kazumasa Yoshida, Nagoya (JP)

(73) Assignee: NGK Spark Plug Co., Ltd., Nogoya-Shi, Aichi (JP)

( * ) Notice: Subject to any disclaimer, the term of this patent is extended or adjusted under 35 U.S.C. 154(b) by 146 days.

(21) Appl. No.: 12/339,599

(22) Filed: Dec. 19, 2008

(65) Prior Publication Data

US 2009/0160305 A1 Jun. 25, 2009

(30) Foreign Application Priority Data

Dec. 19, 2007 (JP) ..... P2007-326950

(51) Int. Cl.
*H01T 13/20* (2006.01)

(52) U.S. Cl. ..... 313/141; 123/169 EL

(58) Field of Classification Search ..... 313/118, 313/141, 143; 123/169 EL
See application file for complete search history.

(56) References Cited

U.S. PATENT DOCUMENTS

| | | | | |
|---|---|---|---|---|
| 5,210,457 | A | 5/1993 | Oshima et al. | |
| 6,798,124 | B2 * | 9/2004 | Hiramatsu | 313/141 |
| 7,230,370 | B2 * | 6/2007 | Kato | 313/141 |
| 2003/0111042 | A1 * | 6/2003 | Rieger et al. | 123/297 |

FOREIGN PATENT DOCUMENTS

JP 60-235379 11/1985

* cited by examiner

*Primary Examiner*—Karabi Guharay
(74) *Attorney, Agent, or Firm*—Stites & Harbison PLLC; Jeffrey A. Haeberlin

(57) ABSTRACT

A spark plug includes an outer electrode including an outer electrode tip of which a distal end surface is spaced from an outer peripheral surface of a leading end portion of a center electrode to define a spark discharge gap. A protruding insulator portion of a cylindrical insulator protrudes at least 1.0 mm from a leading end surface of a cylindrical metal shell. A protruding center electrode portion of the center electrode protrudes at least 3.5 mm from the leading end surface of the cylindrical metal shell. A relationship $(\theta 1+\theta 2)/2 \geqq 75$ degrees is satisfied where the angle $\theta 1$ is defined as a central angle (degrees) of a first circular sector having a point B1 as a center thereof, and the angle $\theta 2$ is an average value (degrees) of the central angles of two second circular sectors having the point B1 as a center thereof.

8 Claims, 28 Drawing Sheets

COMPARISON BETWEEN GROUND ELECTRODE TEMPERATURE AND BREAKAGE STRENGTH

RELATIONSHIP BETWEEN ANGLES θ 1 AND θ 2 AND IGNITABILITY AND DURABILITY

ACTUAL DEVICE IGNITABILITY EVALUATION RESULTS

DESK SPARK DURABILITY EVALUATION RESULTS (Gap 0.7)

DESK SPARK DURABILITY EVALUATION RESULTS (Gap 0.9)

DESK SPARK DURABILITY EVALUATION RESULTS (Gap 1.1)

IGNITABILITY EVALUATION RESULTS

IGNITABILITY EVALUATION RESULTS

ACTUAL DEVICE DURABILITY EVALUATION RESULTS

RELATIONSHIP BETWEEN GROUND ELECTRODE TIP LENGTH AND IGNITABILITY AND DURABILITY

PRE-IGNITION RESISTANCE TEST RESULTS

TIP RESIDUAL RATIO TEST RESULTS

SPARK PLUG HAVING SPECIFIC CONFIGURATION OF CENTER ELECTRODE WITH RESPECT TO OUTER ELECTRODE

CROSS-REFERENCE TO RELATED APPLICATIONS

This application is based on and claims priority to Japanese Patent Application No. 2007-326950 filed Dec. 19, 2007, the above application incorporated herein by reference in its entirety.

BACKGROUND OF THE INVENTION

1. Field of the Invention

This present invention relates to a spark plug for an internal combustion engine, the spark plug including a cylindrical metal shell, a cylindrical insulator provided in the metal shell, a center electrode provided in the insulator, and an outer electrode including an outer electrode tip welded to an outer electrode base member.

2. Description of Related Art

A spark plug having an outer electrode including an outer electrode base member and a column-shaped outer electrode tip welded to the outer electrode base member is known. This spark plug improves ignitability and durability. In the outer electrode, however, since the outer electrode tip is welded, the overall length of the outer electrode tends to become long. Therefore, the heat load at operating time increases, and the breakage strength against vibration also degrades. In order to enhance the heat dissipation property and the strength of the outer electrode, JP-B-1918156 describes a spark plug including a copper core sealed in an outer electrode, and JP-A-60-235379 describes a spark plug in which a leading end portion of a metal shell is extended longer toward a leading end side or a cross-sectional area of an outer electrode is increased.

For low fuel consumption and low emission, high ignition performance and also high output performance are demanded for a recent internal combustion engine. Accordingly, an internal combustion engine with a high compression ratio has been developed, but the heat amount received by the spark plugs thereof to further increase. Since the size of an outer electrode also needs to be reduced because of a requirement for a smaller diameter of a spark plug, the heat resistance and breakage resistance properties of the outer electrode become more and more strict. To solve this problem, shortening the length of the outer electrode is the most effective. However, it is known that a spark plug of a multiple electrode type and a spark plug of a semi-surface type, which can shorten an outer electrode, are inferior in ignitability to a spark plug of a parallel electrode type requiring a relatively long outer electrode.

BRIEF SUMMARY OF THE INVENTION

The present invention was made in consideration of the above circumstances, and an object thereof is to provide a spark plug capable of enhancing ignitability while ensuring the heat resistance and breakage resistance properties of the outer electrode.

In a first aspect, the present invention provides a spark plug comprising a cylindrical metal shell, a cylindrical insulator, a center electrode, and an outer electrode. The cylindrical metal shell has a leading end surface and a base end, and defines an axial direction. The cylindrical insulator is held by the cylindrical metal shell and comprises a leading end surface, a base end, and a protruding insulator portion protruding from the leading end surface of the cylindrical metal shell in the axial direction. The center electrode is held by the insulator and comprises a leading end portion and a protruding center electrode portion protruding from the leading end surface of the cylindrical metal shell in the axial direction. The protruding center electrode portion comprises a center electrode leading end portion being column shaped, extending in the axial direction, and having an outer peripheral surface. The outer electrode comprises: an outer electrode base member having a base end and a distal end; and a columnar outer electrode tip having a distal end surface. The columnar outer electrode tip is welded to the distal end of the outer electrode base member and is narrower, or more slender, than the outer electrode base member. The distal end surface of the columnar outer electrode tip is spaced from the outer peripheral surface of the center electrode leading end portion to define a spark discharge gap. The protruding insulator portion of the cylindrical insulator protrudes at least 1.0 mm from the leading end surface of the cylindrical metal shell. The protruding center electrode portion of the center electrode protrudes at least 3.5 mm from the leading end surface of the cylindrical metal shell. Further, a following relationship is satisfied: $(\theta 1+\theta 2)/2 \geqq 75$ degrees, wherein, in defining $\theta 1$ and $\theta 2$: at least one line segment A connecting the distal end surface of the outer electrode tip and the outer peripheral surface of the center electrode leading end portion at a shortest distance therebetween; a point A1 is defined as a midpoint of the at least one line segment A; a line segment B is a collection of the points A1; a point B1 is defined as a midpoint of the line segment B; the angle $\theta 1$ is defined as a central angle, in degrees, of a first circular sector, and when viewed from a direction perpendicular to the axial direction and also perpendicular to a center axis of the outer electrode tip, the first circular sector includes the point B1 as a center thereof and is defined by two radii and an arc, one of the radii contacting the center electrode leading end portion, the other of the radii contacting the outer electrode, the arc being positioned on a leading end side in the axial direction relative to another arc defined by the two radii, and an inner area of the first circular sector containing neither the center electrode leading end portion nor the outer electrode, and the angle $\theta 2$ is an average value, in degrees, of the central angles of two second circular sectors, and when viewed from the leading end side toward a base end side in the axial direction, each of the second circular sectors includes the point B1 as a center thereof and is defined by two further radii and a further arc, one of the further radii contacting the center electrode leading end portion, the other of the further radii contacting the outer electrode, and an inner area of each of the second circular sectors containing neither the center electrode leading end portion nor the outer electrode.

In the spark plug according to the first aspect of the invention, the distal end surface of the outer electrode tip is spaced from the outer peripheral surface of the center electrode leading end portion to define the spark discharge gap. Accordingly, a spark discharge passage is formed in the radial direction, which is different from a general spark discharge passage formed in the axial direction. That is, the spark plug is a spark plug of a lateral discharge type. Consequently, the length of the outer electrode can be shortened in both the axial direction and the radial direction, so that the temperature of the outer electrode can be decreased and the breakage resistance strength can be enhanced. Therefore, the heat resistance and breakage resistance properties of the outer electrode can be enhanced.

The outer electrode tip is narrower, or more slender, than the outer electrode base member and is welded to the outer electrode base member to form the outer electrode. Thus, although the spark plug is of the lateral discharge type, the flame kernel quenching effect which inhibits growth of the flame kernel, can be reduced, so that ignitability can be enhanced. Thus, the flame kennel quenching effect of the outer electrode (outer electrode tip) being at a lower temperature than the flame kernel when the flame kernel spreads is reduced because the distal end portion of the outer electrode is the narrow outer electrode tip.

Further, in the spark plug of the first aspect of the invention, the protruding insulator portion of the insulator protrudes 1.0 mm or more from the leading end surface of the metal shell toward the leading end side in the axial direction. Thus, the pre-ignition resistance is enhanced because as the protruding length of the insulator is increased, the cooling effect of fresh air increases and enhances the pre-ignition resistance.

In the spark plug of the first aspect of the invention, the protruding center electrode portion of the center electrode protrudes at 3.5 mm or more from the metal shell leading end surface of the metal shell toward the leading end side in the axial direction. Thus, the combustion fluctuation rate can be reduced and ignitability can be enhanced. The combustion fluctuation rate is the fluctuation rate of IMEP (indicated mean effective pressure) found from combustion pressure, and can be found as combustion fluctuation rate=(standard deviation/average value)×100(%).

For the angles θ1 and θ2 (degrees) described above, the spark plug of the first aspect of the invention satisfies (θ1+θ2)/2≧75 degrees. Accordingly, the flame kernel quenching effect of each electrode is further reduced, inhibiting the growth of the flame kernel, so that ignitability is further enhanced. The center electrode leading end portion and the outer electrode being at a temperature lower than that of the flame kernel when the flame kernel spreads is reduced by increasing the value of (θ1+θ2)/2.

The "center electrode" may be any electrode satisfying the above-mentioned requirements; it may be formed integrally or, for example, may include a columnar center electrode tip welded to the center electrode base member of a base member.

The "outer electrode" includes the outer electrode base member and the columnar outer electrode tip, which is narrower than the outer electrode base member and is welded to the base member distal end portion of the outer electrode base member as described above. The outer electrode, for example, may be a ground electrode with a columnar outer electrode tip joined to a predetermined position of the distal end surface of the distal end portion of the ground electrode base member such that the outer electrode tip protrudes toward the center electrode. As another example, the outer electrode may be a ground electrode with a columnar outer electrode tip joined to a predetermined position of a part of a side surface of the of the distal end portion of the ground electrode base member such that the outer electrode tip protrudes beyond the distal end surface of the ground electrode base member.

The "outer electrode tip" of the "outer electrode" may be a columnar; (e.g., cylindrical, prismatic such as a quadrangular prism, cylindroidal, etc.) tip.

The "first circular sector" has one radius contacting the center electrode leading end portion, and the other radius contacting the outer electrode. Therefore, the other radius may contact the outer electrode base member or may contact the outer electrode tip.

Each of the two "second circular sectors" has one further radius contacting the center electrode leading end portion, and the other further radius contacting the outer electrode. Therefore, the other further radius of each of the two second circular sectors may contact the outer electrode base member or may contact the outer electrode tip.

According to one implementation, the following relationships are satisfied: (θ1+θ2)/2≦135 degrees; and −40 degrees≦(θ2−θ1)≦20 degrees. Accordingly, the increasing amount of the spark discharge gap produced with use is effectively suppressed, so that the durability of the spark plug can be enhanced. It is understood that, as the angles θ1 and θ2 are defined in the above-described range, the outer electrode tip can be thickened and shortened to some extent and, thus, the heat dissipation of the outer electrode tip improves and the wear amount of the outer electrode tip is suppressed.

In another implementation, $V \geqq 0.020\ mm^3$, where V is a total volume, in $mm^3$ of a portion of the center electrode leading end and a portion of the outer electrode which are contained in an imaginary sphere, the imaginary sphere having the point B1 as a center thereof with a radius AD/2+0.1 mm, where AD is defined as a length, in mm, of the line segment A. Accordingly, a rise in the discharge voltage produced with use is effectively suppressed, so that the durability of the spark plug can be further enhanced. As the volume V is increased, the volumes of the center electrode leading end portion and the outer electrode, which are consumed by the time the spark discharge gap increases 0.2 mm from the initial spark discharge gap, also increase. Therefore, increase in the spark discharge gap is suppressed or reduced.

In yet another implementation, a following relationship is satisfied: $S \leqq AD/2+0.15\ mm^2$, where S is defined as a total surface area in $mm^2$ of a portion of a surface of the center electrode leading end portion and a portion of a surface of the outer electrode which are contained in the imaginary sphere.

Accordingly, ignitability can be further enhanced. As the area S decreases, the areas of the center electrode leading end portion and the outer electrode which the flame kernel contacts decrease. Therefore, the growth of the flame kernel is less inhibited.

In a further implementation, a following relationship is satisfied: 0.3 mm≦C≦1.6 mm, where C is defined as a tip length, in mm, of the outer electrode tip from a distal end surface of the outer electrode base member to the distal end surface of the outer electrode tip. As C≧0.3 mm is set, ignitability can be enhanced. Increasing as the tip length C reduces the effect of the outer electrode being at a lower temperature than the flame kernel. On the other hand, as C≦1.6 mm is set, the increasing amount of the spark discharge gap G produced with use effectively suppressed and the durability of the spark plug is enhanced. As the tip length C is shortened, the heat dissipation in the outer electrode (outer electrode tip) improves and the wear amount of the outer electrode tip is suppressed. Therefore, the tip length C is defined in the range 0.3 mm≦C≦1.6 mm, whereby both ignitability and durability are enhanced.

In a still further implementation, the center electrode further comprises: a center electrode base member; and a columnar center electrode tip having a diameter smaller than that of the center electrode base member and welded to the center electrode base member, the center electrode tip defining the center electrode leading end portion. Accordingly, ignitability is further enhanced. The leading end portion of the center electrode includes the narrow center electrode tip, thus reducing the effect of the center electrode (center electrode tip) being at a lower temperature than the flame kernel when the flame kernel spreads.

According to yet another implementation, each of the outer electrode tip and the center electrode tip may be formed of a Pt alloy containing Pt in an amount at least 70 wt %. Thus, the wear of the tip produced with use is suppressed, so that the durability of the spark plug is further enhanced.

According to yet another implementation, each of the outer electrode tip and the center electrode tip comprises an Ir alloy containing Ir and Rh. Thus, the wear of the tip produced with use is suppressed, so that the durability of the spark plug is further enhanced.

Other features and advantages of the invention will be set forth in, or apparent from, the detailed description of the exemplary embodiments of the invention found below.

DETAILED DESCRIPTION OF EXEMPLARY EMBODIMENTS OF THE INVENTION

1. First Exemplary Embodiment

Figure 1:
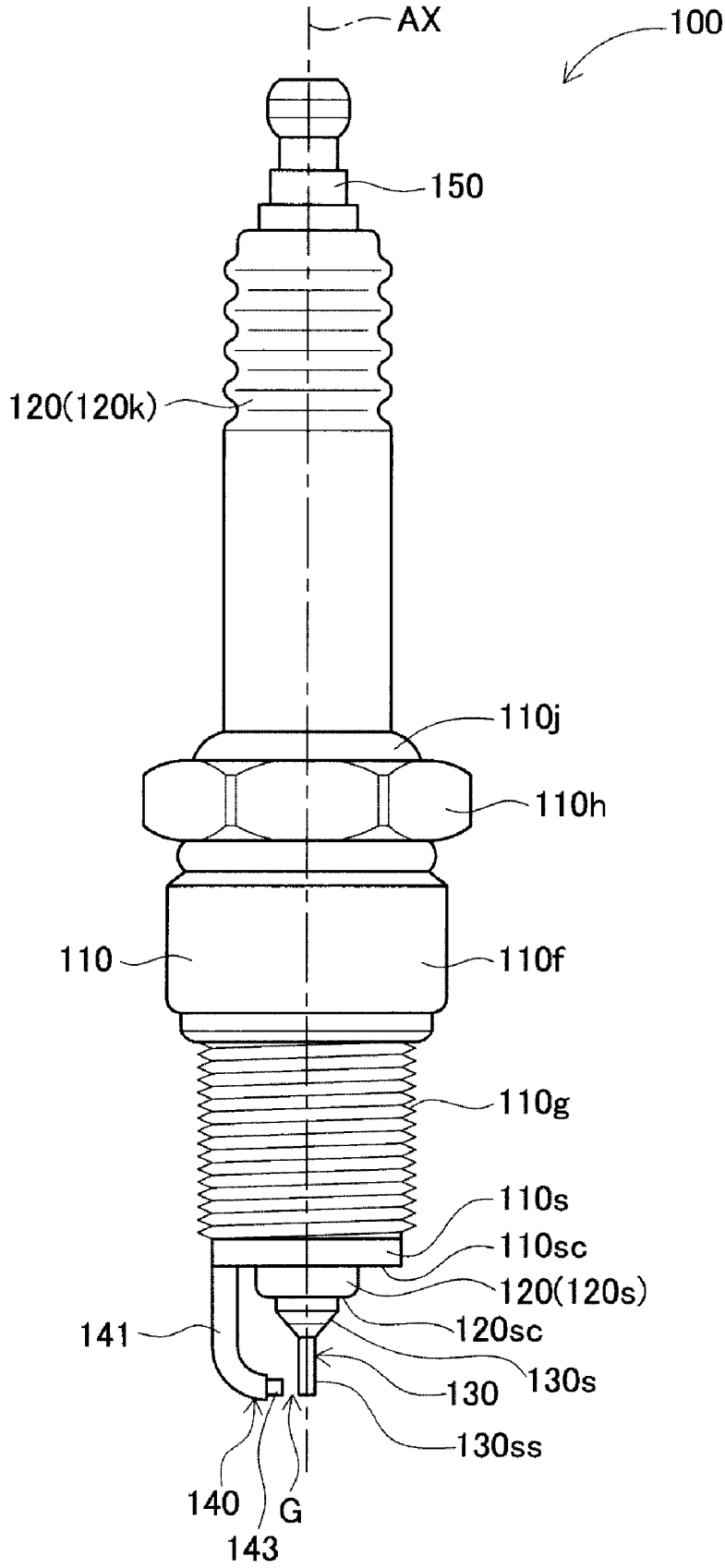
FIG. 1 is a side elevational view of a spark plug according to an exemplary embodiment of the invention.
Figure 2:
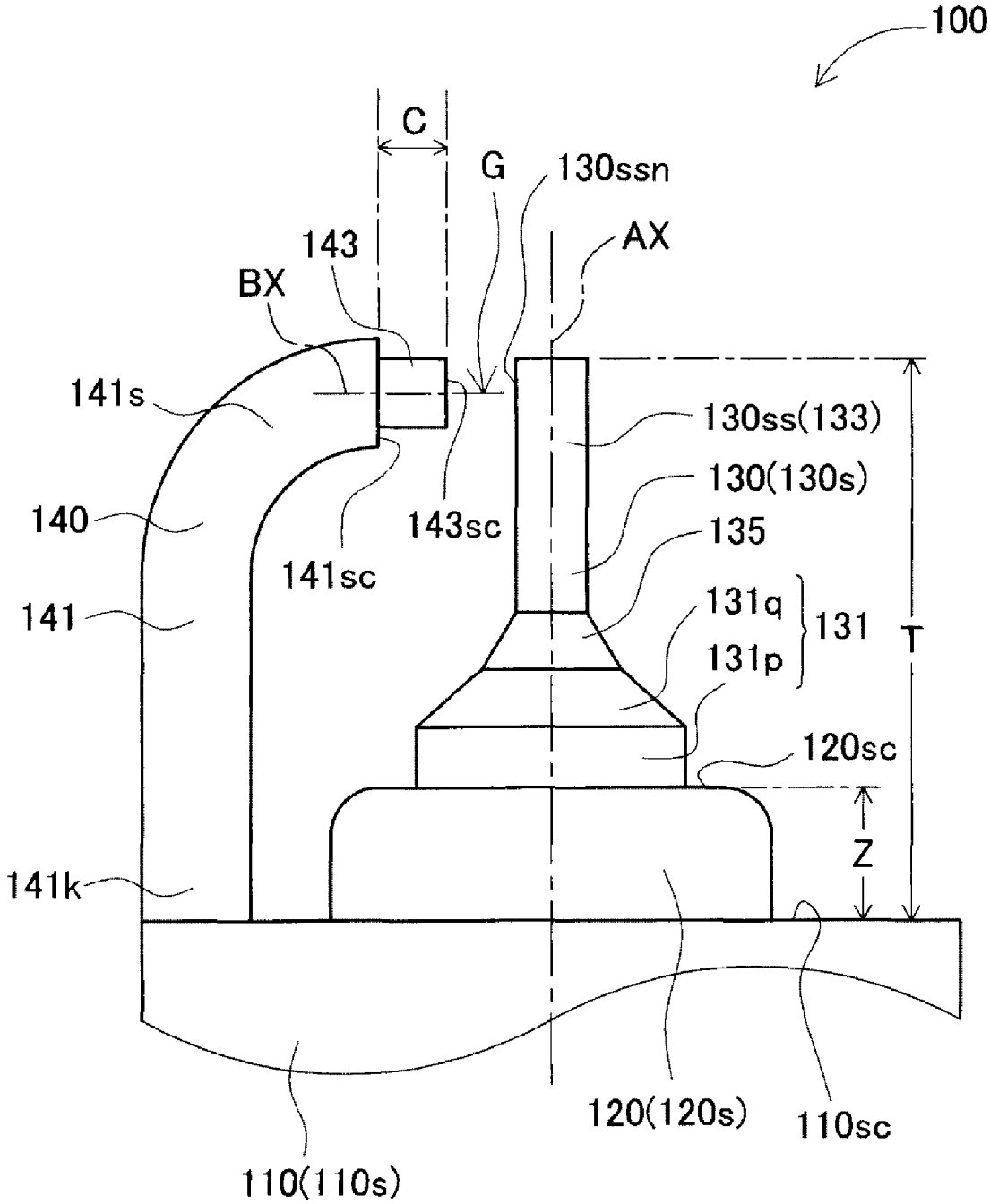
FIG. 2 is a side elevational view of a center electrode and a ground electrode of the spark plug of FIG. 1.
Figure 3:
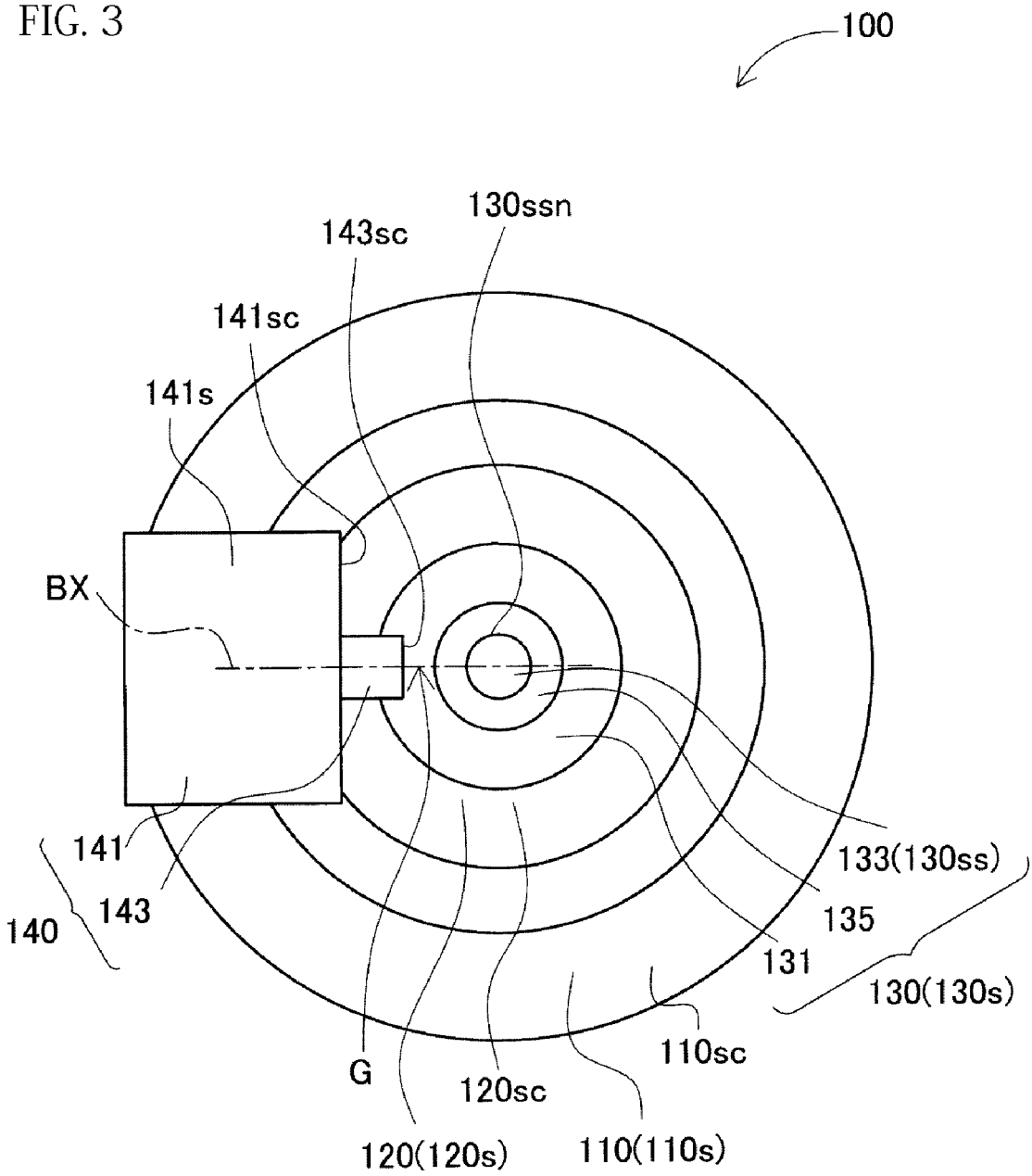
FIG. 3 is a plan view as viewed from a leading end side showing the center electrode and the ground electrode of the spark plug.
Figure 4:
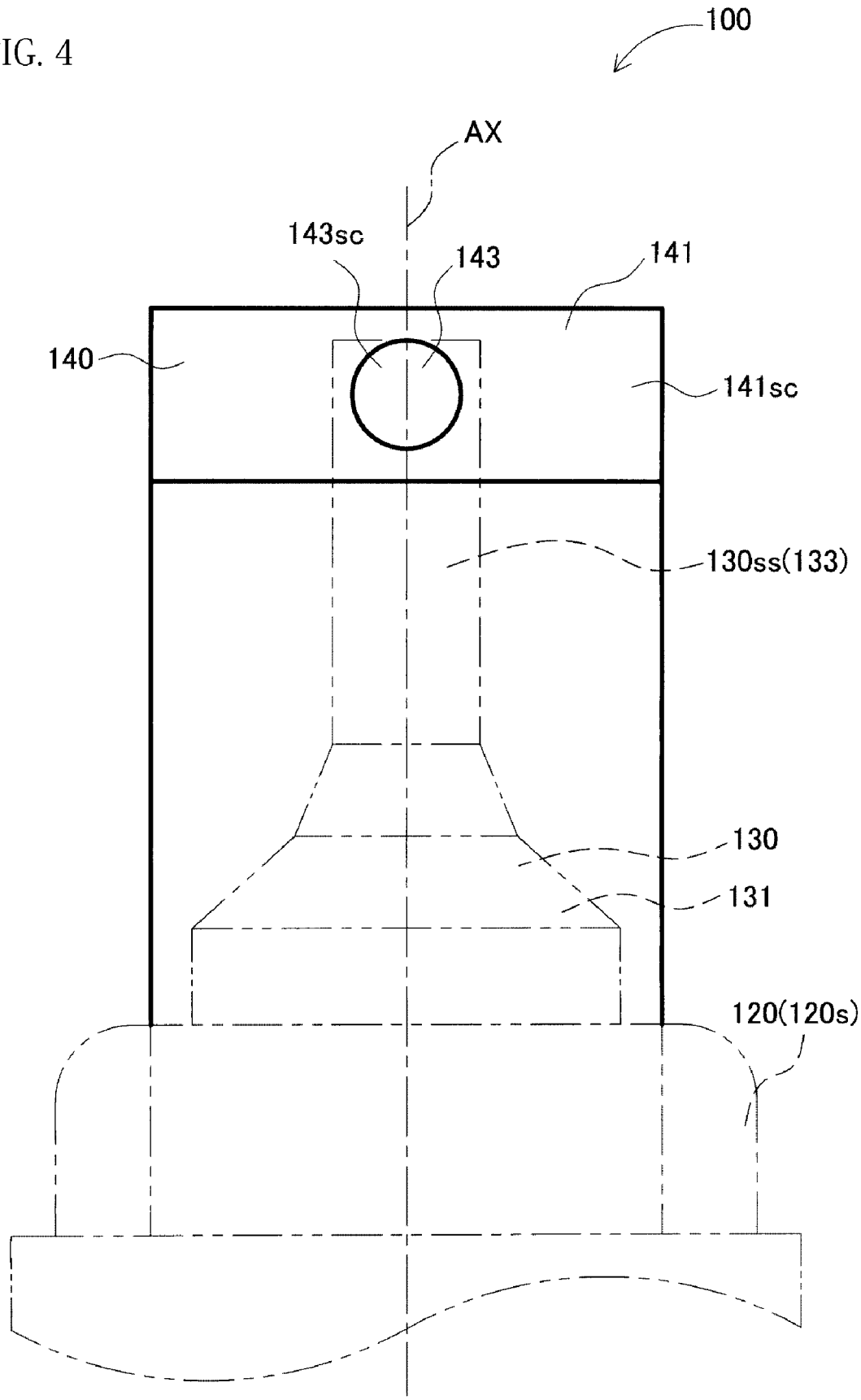
FIG. 4 is a schematic diagram of the ground electrode of the spark plug of FIG. 1 viewed from the radial inside of the spark plug.

An exemplary embodiment of the present invention is described with reference to the drawings. However, the present invention should not be construed as being limited thereto. FIG. 1 shows a spark plug 100 according to the exemplary embodiment of the invention. FIG. 2 shows the vicinity of a center electrode 130 and a ground electrode (outer electrode) 140 viewed from a side of the spark plug 100. FIG. 3 shows the center electrode 130, the ground electrode 140 viewed from an axis AX direction leading end side (which will be hereinafter also simply referred to as a "leading end side") to a base end side. FIG. 4 shows the ground electrode 140 viewed from the radial inside to the radial outside. The spark plug 100 is a spark plug for an internal combustion engine which, in use, is attached to a cylinder head of an engine.

As shown in FIG. 1, the spark plug 100 includes a cylindrical metal shell 110, a cylindrical insulator 120, the center electrode 130, and the ground electrode 140.

The metal shell 110 contains low carbon steel and has a cylindrical shape extending in the axis AX direction. The metal shell 110 includes a flange portion **110*f* of a large diameter, a tool engagement portion 110*h* having a hexagon shape in cross section and positioned on an axis AX direction base end side (which will be hereinafter also called simply the base end side; corresponding to upper side in FIG. 1) in relation to the flange portion 110*f*, for engaging a tool when the spark plug 100 is attached to the cylinder head of the engine, and a crimping portion 110*j* positioned on the base end side of the tool engagement portion 110*h* for crimping and fixing the insulator 120 to the metal shell 110. The metal shell 110 also includes a leading end portion 110***s* provided on the leading end side (lower side in FIG. 1) of the flange portion 110*f* and having a diameter smaller than that of the flange portion 110*f*. On the outer periphery of the leading end portion 110*s*, a threaded portion 110*g* to allow the spark plug 100 to be screwed into the cylinder head.

The insulator 120 contains an alumina-based ceramic and has a cylindrical shape extending in the axis AX direction. The insulator 120 is inserted into the radial inside of the metal shell 110 and is held in the metal shell 110 in a state in which: a protruding insulator portion 120*s* positioned on the leading end side protrudes from a leading end surface 110*sc* of the metal shell 110 toward the leading end side; and an insulator base end portion 120*k* positioned on the base end side protrudes from the crimping portion 110*j* of the metal shell 110 toward the base end side. A protruding length Z (see FIG. 2) of the insulator protruding portion 120*s* positioned on the leading end side from the metal shell leading end surface 110*sc* of the metal shell 110 is 1.0 mm or more. The specific numeric value of the protruding length Z is described later.

The center electrode 130 is inserted into the radial inside of the leading end side of the insulator 120. A terminal fitting 150 for introducing a high voltage into the center electrode 130 is inserted into the radial inside of the base end side of the insulator 120. The center electrode 130 is held in the insulator 120 in a state in which a center electrode protruding portion 130*s* positioned on the leading end side protrudes from a leading end surface 120*sc* of the insulator 120 toward the leading end side. A protruding length T (see FIG. 2) of the center electrode protruding portion 130*s* from the leading end surface 110*sc* of the metal shell 110 is 3.5 mm or more. The specific numeric value of the protruding length T is described later.

As shown in FIG. 2 and FIG. 3, the center electrode 130 includes: a rod-shaped center electrode base member 131 as a base member; and a columnar center electrode tip 133 coaxially welded to a leading end of the center electrode base member 131 as a rod-shaped base member. The center electrode tip 133 has a diameter smaller than that of the center electrode base member 131. The center electrode base member 131 is positioned on the base end side (bottom in FIG. 2), and the center electrode tip 133 is positioned on the leading end side (top in FIG. 2).

The center electrode base member 131 includes: a first column portion 131*p* positioned on the base end side and having a column shape with a large diameter; and a truncated cone portion 131*q* positioned on the leading end side and having a truncated cone shape with a diameter decreasing toward the leading end side. The center electrode base member 131 is formed of a Ni alloy containing Ni as a primary or main component. As used herein, the term "main component" means contained in an amount of 50 wt % or more.

On the other hand, the center electrode tip 133 protrudes from the center electrode base member 131 toward the leading end side (upper side in FIG. 2) and defines a columnar center electrode leading end portion 130*ss* defining at least a part of the leading end portion of the center electrode 130. The center electrode tip 133 is formed of a Pt alloy containing Pt in an amount of 70 wt % or more. The specific material of the center electrode tip 133 is described later. The center electrode tip 133 may be formed of an Ir alloy with Rh added thereto.

Since the center electrode tip 133 and the center electrode base member 131 are laser-welded, a molten bond 135 having a truncated cone shape is formed between the center electrode tip 133 and the center electrode base member 131. In the molten bond 135, the center electrode tip 133 and the center electrode base member 131 are fused, mixed and harden.

As shown in FIG. 2 through FIG. 4, the ground electrode 140 includes: a ground electrode base member (outer electrode base member) 141 as a base member formed by bending a quadrangular prism; and a columnar ground electrode tip (outer electrode tip) 143 having a diameter smaller than the ground electrode base member 141 and welded to the ground electrode base member 141.

The ground electrode base member 141 is formed of a Ni alloy containing Ni as a main component. The ground electrode base member includes: a base member base end portion 141*k* joined to the leading end surface 110*sc* of the metal shell 110; a base member distal end portion 141*s* bent toward the radial inside; and a base member distal end surface 141*sc* directed toward the radial inside.

The ground electrode tip 143 has a column shape extending along a center axis BX, is laser-welded to the center of the base member distal end surface 141*sc* of the ground electrode base member 141, and protrudes toward the radial inside. A tip distal end surface 143*sc* of the ground electrode tip 143 is spaced from an outer peripheral surface 130*ssn* of the center electrode leading end portion 130*ss* with a spark discharge gap G for carrying out spark discharge. The spark plug 100 satisfies 0.3 mm≦C≦1.6 mm where C is the tip length (mm) of the ground electrode tip 143 from the base member tip face 141*sc* to the tip distal end surface 143*sc*. The specific numeric value of the length C is described later. The ground electrode tip 143 is formed of a Pt alloy containing Pt in an amount of 70 wt % or more. The specific material of the ground electrode tip 143 is described later. The ground electrode tip 143 may be formed of an Ir alloy with Rh added thereto.

Figure 5:
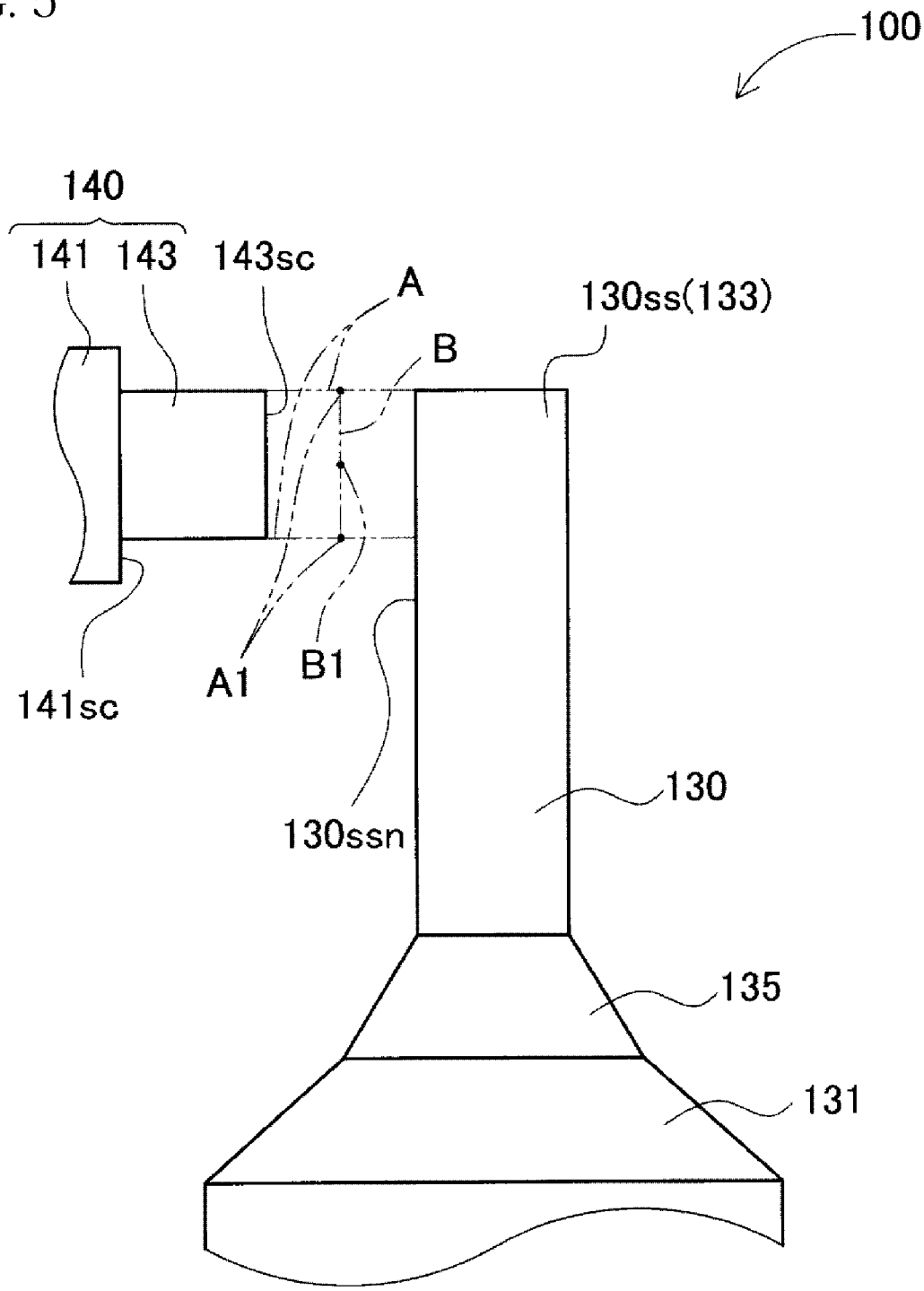
FIG. 5 is a side view of the center electrode and the ground electrode of the spark plug of FIG. 1, schematically illustrating a line segment A, a point A1, a line segment B, and a point B1.

In the spark plug 100, as shown in FIG. 5, an arbitrary line segment connecting the tip distal end surface 143*sc* and the outer peripheral surface 130*ssn* at shortest distance AD (see FIG. 8) from the tip distal end surface 143*sc* of the ground electrode tip 143 to the outer peripheral surface 130*ssn* of the center electrode leading end portion 130*ss* is defined as a line segment A (the figure shows two line segments A positioned at the leading end and a line segment A positioned at the base end). In the example shown in FIG. 5, the tip distal end surface 143*sc* is completely flat and parallel to the outer peripheral surface 130*ssn* (this illustrative example shows an ideal structure of the spark plug). Since the center electrode 130 is cylindrical, an infinite number of line segments A exist between the surfaces 143*sc* and 130*ssn*. However, if the distal end surface 143*sc* is uneven or inclined with respect to the outer peripheral surface 130*ssn*, only one line segment A may exist. A point A1 is defined as the midpoint of each line segment A.

Further, a line segment B is defined as a line segment of a collection of the points A1, and a point B1 is defined as the midpoint of the line segment B. If the distal end surface 143*sc* is uneven and only one line segment A exists, the point A1 also becomes the line segment B and the point B1.

Figure 6:
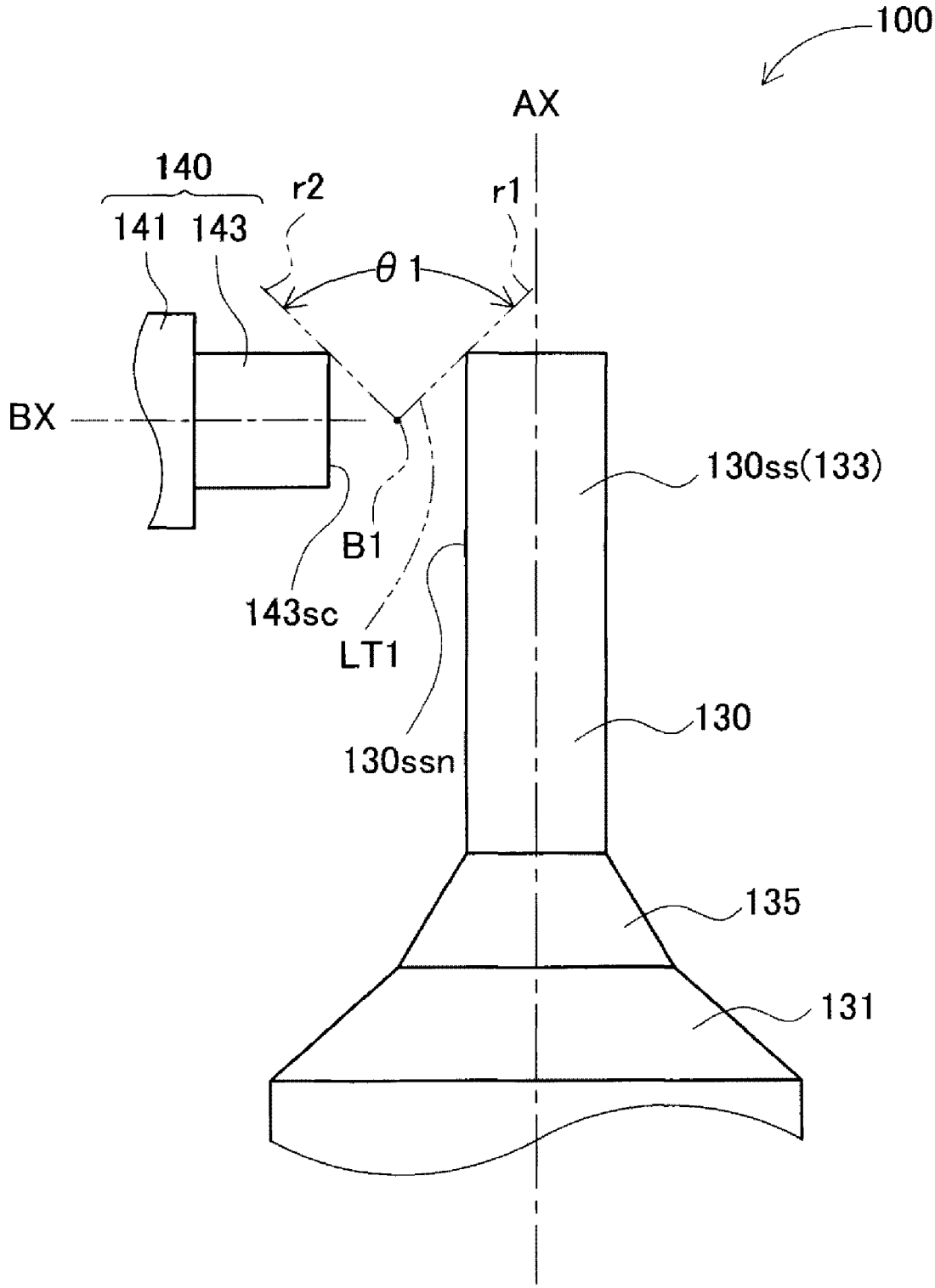
FIG. 6 is a side view of the center electrode and the ground electrode of the spark plug of FIG. 1, schematically illustrating a first circular sector having a central angle θ1.

Next, the spark plug 100 is viewed from the side direction perpendicular (normal) to the axis AX and perpendicular (normal) to a center axis BX of the ground electrode tip 143 as shown in FIG. 6. A first circular sector LT1 is drawn with the point B1 as the center toward the leading end side (top in FIG. 6) to have one radius r1 contacting (tangent to) a center electrode distal end portion 130*ss* and the other radius r2 contacting (tangent to) the ground electrode 140 (in the example, the ground electrode tip 143 of the ground electrode 140). The inner area of the first circular sector LT1 contains neither the center electrode leading end portion 130*ss* nor the ground electrode 140. The central angle of the first circular sector LT1 is defined as an angle θ1 (degrees).

Figure 7:
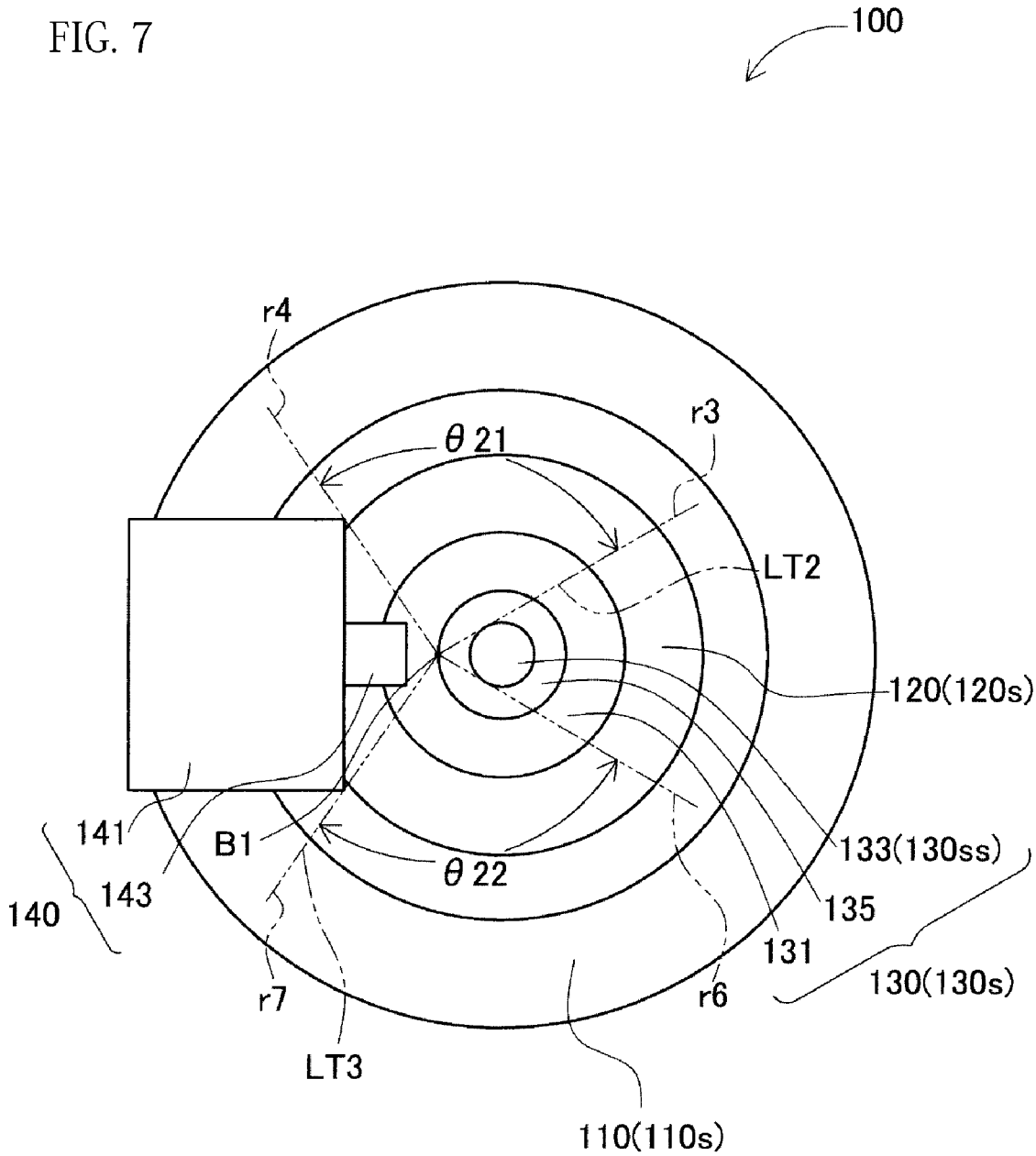
FIG. 7 is a plan view as viewed from the leading end side showing the center electrode and the ground electrode of the spark plug of FIG. 1, schematically illustrating two second circular sectors having central angles θ21 and θ22.

FIG. 7 shows the spark plug 100 viewed from the leading end side toward the base end side in the axis AX direction. A second circular sector LT2 is drawn with the point B1 as the center to have one radius r3 contacting (tangent to) the center electrode leading end portion 130*ss* and the other radius r4 contacting (tangent to) the ground electrode 140 (in FIG. 7, the ground electrode base member 141 of the ground electrode 140). Likewise, a second circular sector LT3 is also drawn with the point B1 as the center to have one radius r6 contacting (tangent to) the center electrode leading end portion 130*ss* and the other radius r7 contacting (tangent to) the ground electrode 140 (in FIG. 7, the ground electrode base member 141 of the ground electrode 140). The inner area of each of the second circular sectors LT2 and LT3 contains neither the center electrode leading end portion 130*ss* nor the ground electrode 140. The central angle of one second circular sector LT2 is defined as an angle θ21 (degrees), the central angle of the other second circular sector LT3 is defined as an angle θ22 (degrees), and an average value thereof is defined as an angle θ2 (degrees). In the illustrated embodiment, the two second circular sectors LT2 and LT3 are drawn symmetrically, and the angles θ21 and θ22 are the same degrees and thus relationship θ21=θ22=θ2 is satisfied.

For the angles θ1 and θ2, the spark plug 100 of the embodiment satisfies relationships: 75 degrees≦(θ1+θ2)/2≦135 degrees; and −40 degrees≦(θ2−θ1)≦20 degrees. The specific numeric values of the angles θ1 and θ2 are described later.

Figure 8:
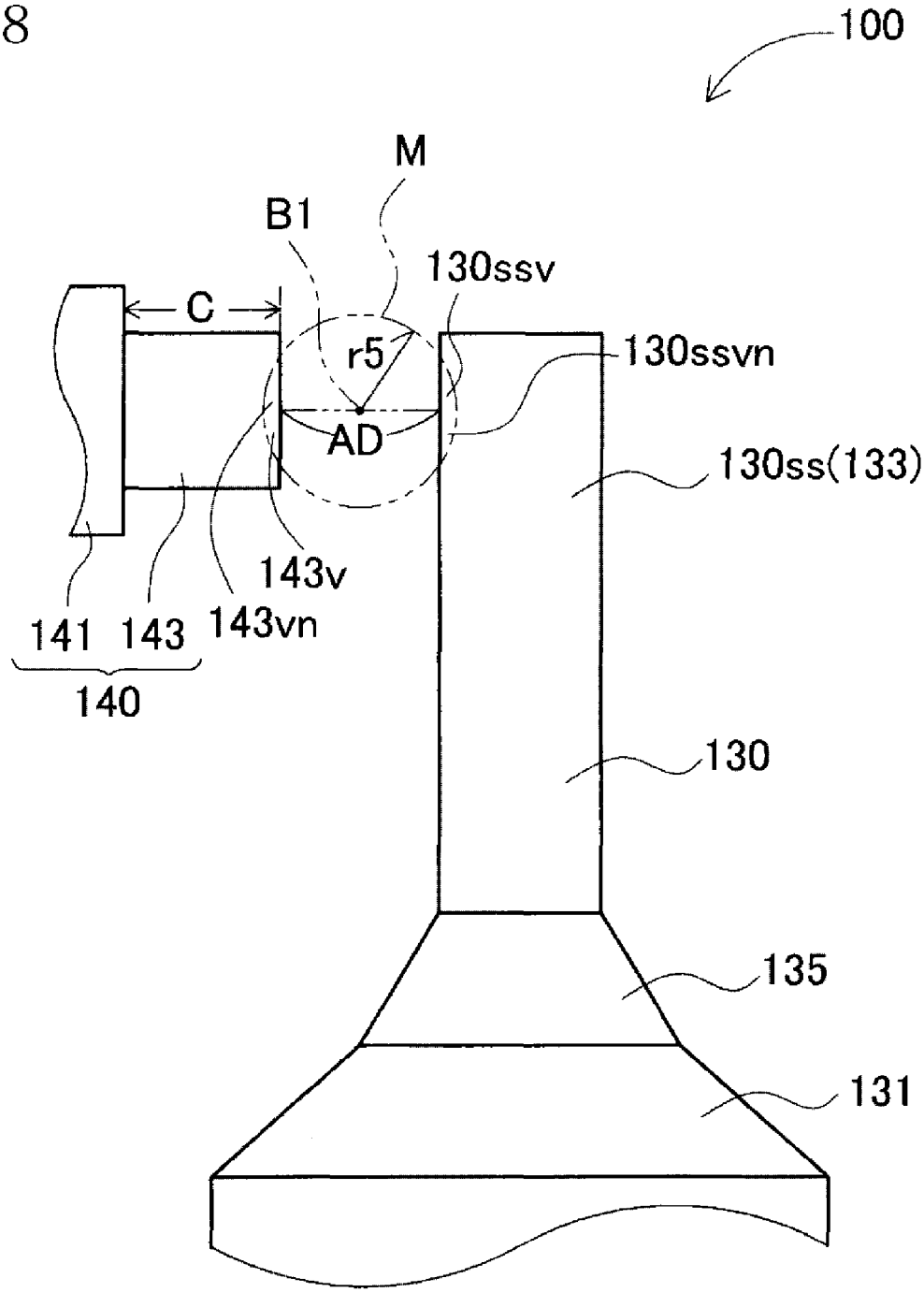
FIG. 8 is a side view of the center electrode and the ground electrode of the spark plug of FIG. 1, schematically illustrating an imaginary sphere M.

As shown in FIG. 8, an imaginary sphere M is assumed. The imaginary sphere M has the point B1 as the center thereof with radius r5=AD/2+0.1 (mm) where AD is the length of the line segment A (mm) (in the embodiment, also corresponding to the length or spread of the spark discharge gap G). Here, the volume of a portion 130*ssv* of the center electrode leading end portion 130*ss* contained in the imaginary sphere M is defined as a volume V1 ($mm^3$), and the volume of a portion 143*v* of the ground electrode 140 contained in the imaginary sphere M is defined as volume V2 ($mm^3$). The total volume V is V=V1+V2 ($mm^3$).

For the total volume V, the spark plug 100 of the embodiment satisfies the relationship V≧0.020 ($mm^3$). The specific numeric value of the volume V is described later in detail.

The area of a surface 130*ssvn* of a portion 130*ssv* contained in the imaginary sphere M, of the surface of the center electrode leading end portion 130*ss* is defined as an area S1 ($mm^2$), and the area of a surface 143*vn* of a portion 143*v* contained in the imaginary sphere M, of the surface of the ground electrode 140 is defined as an area S2 ($mm^2$). The total surface area S of the areas S1 and S2 satisfies the relationship S=S1+S2 ($mm^2$).

For the area S, the spark plug 100 of the embodiment satisfies the relationship S≦AD/2+0.15 ($mm^2$). The specific numeric value of the area S is described later.

As described above, in the spark plug 100, as the ground electrode 140, the tip distal end surface 143*sc* of the ground electrode tip 143 is spaced from the outer peripheral surface 130*ssn* of the center electrode leading end portion 130*ss* with the spark discharge gap G toward the radial inside, and a spark plug of lateral discharge type with a spark discharge passage formed in the radial direction is provided. Accordingly, the length of the ground electrode 140 can be shortened in both the axis AX direction and the radial direction, so that the operating temperature of the ground electrode 140 can be decreased and the breakage resistance strength can be enhanced. Therefore, the heat resistance and breakage resistance properties of the ground electrode 140 can be enhanced.

The ground electrode tip 143, which has a diameter smaller than that of the ground electrode base member 141, is welded to the ground electrode base member 141 to form the ground electrode 140. Thus, although the spark plug 100 is a spark plug of lateral discharge type, the flame kernel quenching effect, which inhibits the growth of the flame kernel, can be decreased so that ignitability can be enhanced. Thus, the flame kernel quenching effect of the ground electrode 140 (ground electrode tip 143) being at a lower temperature than the flame kernel when the flame kernel spreads is reduced because the ground electrode tip 143 has a smaller diameter than the distal end portion of the ground electrode 140.

Further, in the spark plug 100 of the embodiment, the protruding length Z of the insulator protruding portion 120*s* of the insulator 120 is set to 1.0 mm or more. Thus, the pre-ignition resistance performance can be enhanced. As the protruding length Z of the insulator 120 is increased, the cooling effect of fresh air increases and the pre-ignition resistance performance is enhanced.

In the spark plug 100 of the embodiment, the protruding length T of the center electrode protruding portion 130*s* of the ground electrode 130 is set to 3.5 mm or more. Thus, the combustion fluctuation rate (fluctuation rate of IMEP (indicated mean effective pressure) found from combustion pressure) can be reduced, and ignitability can be enhanced.

Further, for the angles θ1 and θ2 (degrees) described above, the spark plug 100 of the embodiment satisfies (θ1+θ2)/2≧75 degrees. Accordingly, the flame kernel quenching effect of the ground electrode 140 and the center electrode 130 can be further decreased, so that ignitability can be still further enhanced. The ground electrode 140 and the center electrode leading end portion 130*ss* being at a lower temperature than the flame kernel when the flame kernel spreads is reduced by increasing the value of (θ1+θ2)/2.

Further, for the angles θ1 and θ2 (degrees), the spark plug 100 satisfies (θ1+θ2)/2≦135 degrees and −40 degrees≦(θ2−θ1)≦20 degrees. Accordingly, an increasing amount ΔAD of the length AD of the spark discharge gap G resulting from use can be effectively suppressed, so that the durability of the spark plug 100 can be further enhanced. As the angles θ1 and θ2 are defined in such a range, the ground electrode tip 143 can be thickened and shortened to some extent and, thus, the heat dissipation of the ground electrode tip 143 improves and the wear amount of the ground electrode tip 143 is suppressed.

For the volume V ($mm^3$) described above, the spark plug 100 satisfies V≧0.020 $mm^3$. Accordingly, a rise in the discharge voltage produced with use can be effectively suppressed, so that the durability of the spark plug 100 can be further enhanced. As the volume V is increased, the volumes of the center electrode leading end portion 130*ss* and the ground electrode 140, which are consumed by the time the spark discharge gap G (length AD) increases 0.2 mm from the initial spark discharge gap G (ΔAD=0.2 mm), increase. Therefore, the increasing amount ΔAD of the length AD of the spark discharge gap G is suppressed.

For the area S ($mm^2$) described above, the spark plug 100 satisfies S≦AD/2+0.15 $mm^2$. Accordingly, ignitability can be further enhanced. As the area S is reduced, the areas of the center electrode leading end portion 130*ss* and the ground electrode 140 which the flame kernel contacts decreases. Therefore, the growth of the flame kernel is less inhibited.

In the spark plug 100, the tip length C (mm) of the ground electrode tip 143 satisfies 0.3 mm≦C≦1.6 mm. As C≧0.3 mm is set, ignitability can be enhanced. Increasing the tip length C reduces the effect of the ground electrode 140 being at a lower temperature than the flame kernel. On the other hand, as C≦1.6 mm is set, the increasing amount of the spark discharge gap G resulting from use can be effectively suppressed, and the durability of the spark plug can be enhanced. As the tip length C is thus shortened, the heat dissipation in the ground electrode 140 (ground electrode tip 143) improves and the wear amount of the ground electrode tip 143 is suppressed. Therefore, the tip length C is defined in the range 0.3 mm≦C≦1.6 mm, whereby both ignitability and durability can be enhanced.

In the spark plug 100, the center electrode 130 includes the center electrode tip 133 welded to the center electrode base member 131, and the center electrode tip 133 forms at least a part of the center electrode leading end portion 130*ss*, so that ignitability can be further enhanced. The leading end portion of the center electrode 130 is the narrow center electrode tip 133, thus reducing the effect of center electrode 130 (center electrode tip 133) being at a lower temperature than the flame kernel when the flame kernel spreads.

In the spark plug 100, each of the center electrode tip 133 and the ground electrode tip 143 is formed of a Pt alloy containing Pt in an amount of 70 wt % or more. Thus, the wear of each tip produced with operation can be suppressed, so that the durability of the spark plug can be further enhanced. When each of the center electrode tip 133 and the ground electrode tip 143 is formed of an Ir alloy containing Ir and Rh added thereto, the wear of each tip produced with operation (i.e., resulting from use) can be suppressed, so that the durability of the spark plug can be further enhanced.

The spark plug 100 can be manufactured according to the following method: The center electrode tip 133 is laser-welded to the center electrode base member 131 to form the center electrode 130. The center electrode 130 is attached to the insulator 120 separately provided, the terminal fitting 150, etc., is also attached the insulator 120, and glass sealing is performed.

Next, the metal shell 110 is provided and the rod-shaped ground electrode base member 141 is joined to the metal shell 110. At this point, the ground electrode tip 143 has not been joined to the ground electrode base member 141 and the ground electrode base member 141 has not been subjected to any bending work. Then, the insulator 120 to which the center electrode 130, etc., is attached is attached to the metal shell 110 to which the ground electrode base member 141 is joined, and crimping, etc., is performed.

Next, the ground electrode tip 143 is laser-welded to the ground electrode base member 141 to form the ground electrode 140. Then, the ground electrode 140 is bent toward the radial inside and is formed to a predetermined shape, and the spark discharge gap G is formed between the ground electrode 140 and the center electrode 130. The spark plug 100 is then complete.

Next, the results of various tests conducted to check the effects of the spark plug 100 of the embodiment will be discussed.

a. Test 1

In Test 1, for each of the spark plug 100 of the embodiment of the invention and a spark plug of a comparative example according to a related art, the temperature at the distal end of the ground electrode 140 at the operating time and the breakage strength of the ground electrode 140 were examined and a comparison was made.

As an example of the embodiment, a spark plug with an angle θ1=104 degrees, an angle θ2=106 degrees, a length AD=0.9 mm, a volume V=0.027 $mm^3$, an area S=0.532 $mm^2$, and a length C=0.9 mm was provided.

As a comparative example according to a related art, a spark plug of the type wherein a tip distal end surface of a ground electrode tip of a ground electrode faces the base end side and is spaced from a leading end surface of a center electrode leading end portion with a spark discharge gap was provided. This spark plug is a spark plug of general longitudinal discharge type (parallel electrode type) with a spark discharge passage formed in an axial direction.

For each of the spark plug 100 of the example and the spark plug of the comparative example, the temperature at the distal end of the ground electrode at the operating time was examined. The breakage strength safety factor ratio of the ground electrode was also examined.

The temperature at the distal end of the ground electrode was measured by attaching a thermocouple to a ground electrode base member at a position 1 mm away from the base member distal end surface of the ground electrode base member. The thermocouple may be embedded in the ground electrode base member.

Figure 9:
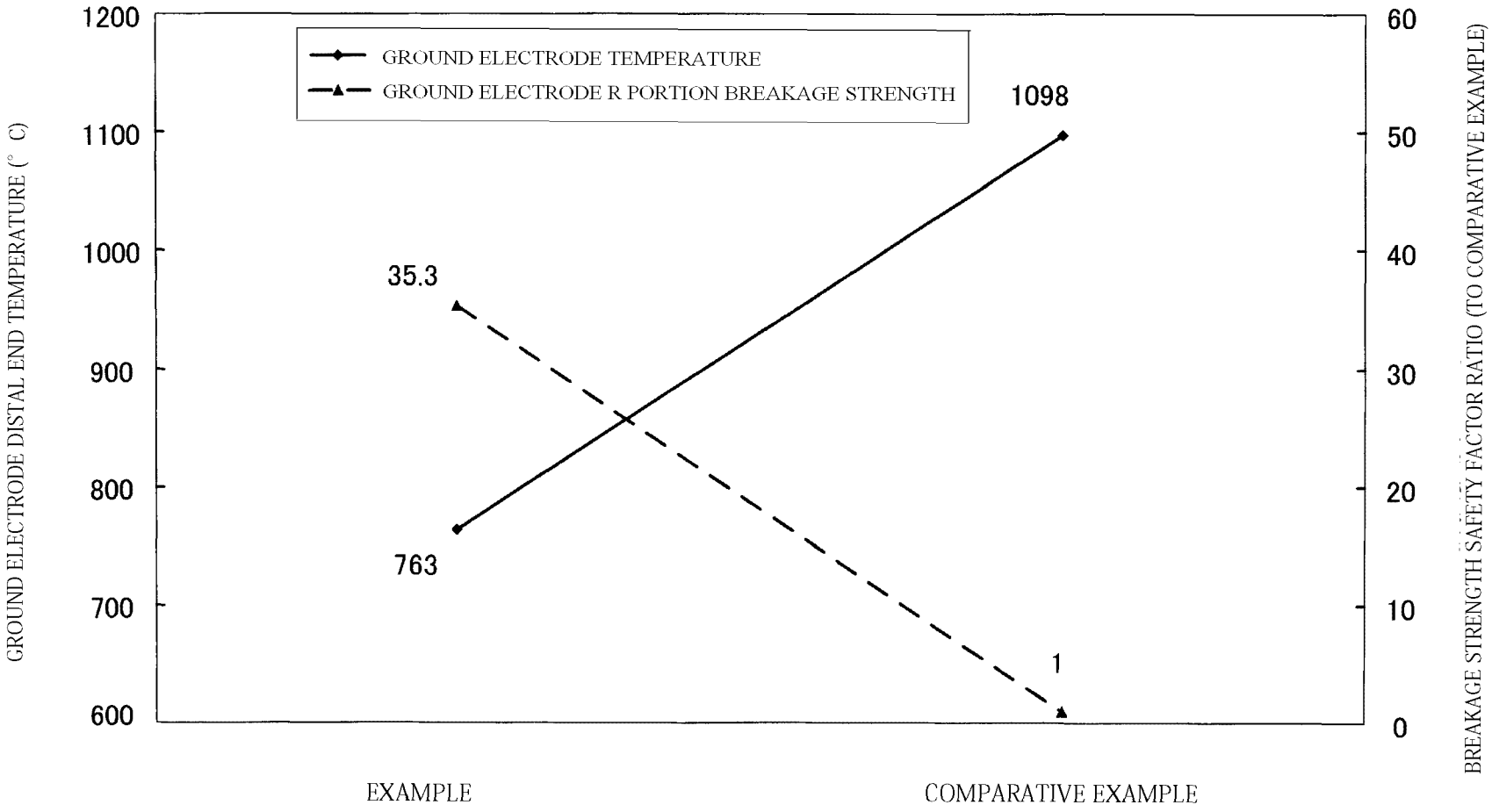
FIG. 9 is a graph showing the temperatures at a distal end and breakage strength safety factor ratios of ground electrodes of spark plugs of an example and a comparative example.

The breakage strength safety factor ratio was found as follows: An ambient temperature condition was set so that the leading end of a center electrode tip became 800° C. based on the material physical values of the portions of the spark plug, and the temperatures of the portions were calculated by FEM analysis. Resonance frequency of the ground electrode was found and material strength σ2 was calculated according to maximum stress σ1 of an R portion (bent portion) when vibration with an acceleration of 1 G was given and the temperature found by the FEM analysis. The safety factor of each spark plug was found as (safety factor)=σ2/σ1 and further the safety factor ratio of the spark plug 100 of the example was found with the spark plug of the comparative example as the reference (=1). FIG. 9 shows the results as a graph.

Consequently, the temperature at the distal end of the ground electrode was 1098° C. in the spark plug of the comparative example; whereas the temperature drastically decreased to 763° C. in the spark plug 100 of the example. On the other hand, the breakage strength safety factor ratio of the spark plug 100 of the example drastically increased to 35.5 times that of the spark plug of the comparative example. Thus, according to the exemplary embodiment, the temperature of the ground electrode 140 can be remarkably decreased and the breakage resistance strength can be remarkably enhanced, so that the heat resistance and breakage resistance properties of the ground electrode 140 are enhanced.

b. Test 2

Figure 10:
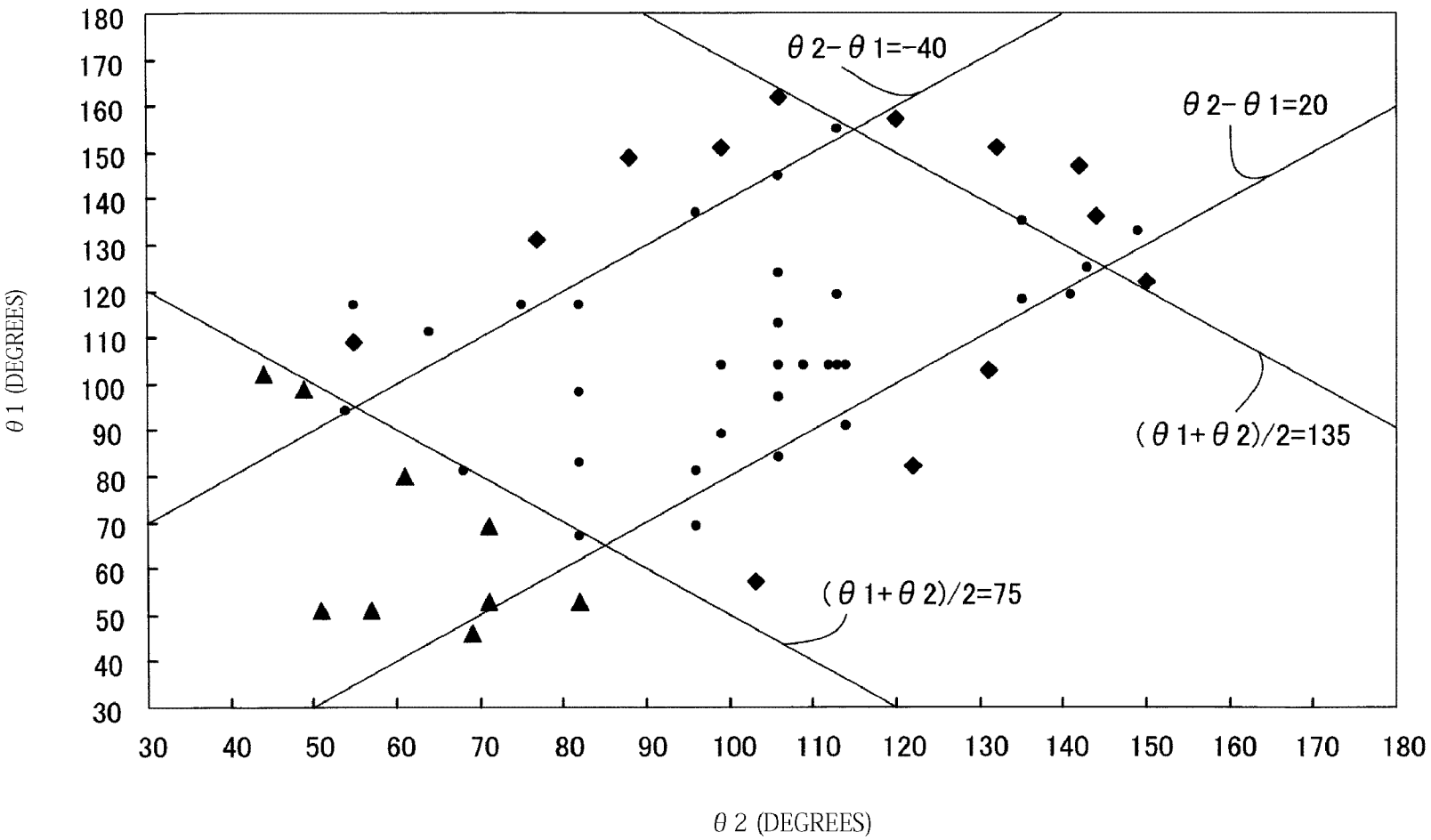
FIG. 10 is a graph showing ignitability and durability of spark plugs having different angles θ1 and θ2.

In Test 2, a large number of spark plugs with different angles θ1 and θ2 were provided. For each of the spark plugs, ignitability and durability were evaluated. FIG. 10 shows the results as a graph. In the graph, each black circle indicates sufficiently high ignitability and durability. On the other hand, each black triangle indicates inferior ignitability. Each black rhombus indicates inferior durability. The ignitability evaluation is described in detail later in Tests 3 and 5. The durability evaluation is described in detail later in Test 4.

Consequently, sufficiently high ignitability can be provided when a relationship (θ1+θ2)/2≧75 degrees is satisfied. Further, sufficiently high durability can be provided when relationships (θ1+θ2)/2≦135 degrees and −40 degrees≦(θ2−θ1)≦20 degrees are satisfied. Therefore, the spark plug is formed so as to satisfy 75 degrees≦(θ1+θ2)/2≦135 degrees and −40 degrees≦(θ2−θ1)≦20 degrees, so that both ignitability and durability can be enhanced.

c. Test 3

Figure 11:
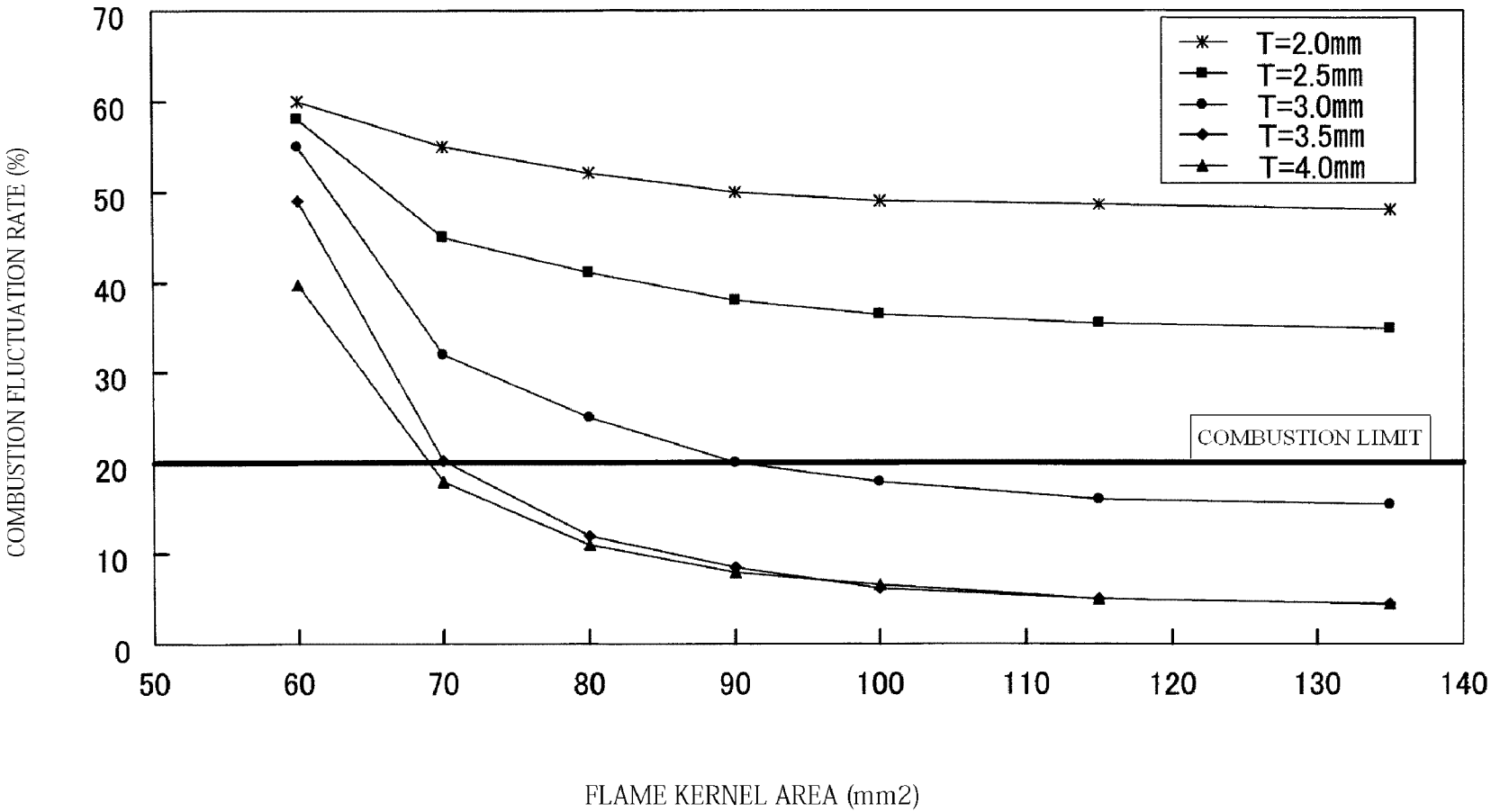
FIG. 11 is a graph showing a relationship between the flame kernel area and combustion fluctuation rate of spark plugs having different protruding lengths of a center electrode leading end portion.

In Test 3, spark plugs with the protruding length T of the center electrode leading end portion 130*ss* set to 2.0 mm, 2.5 mm, 3.0 mm, 3.5 mm, and 4.0 mm, respectively, were provided. For each of the spark plugs, the relationship between the flame kernel area according to schlieren evaluation and the combustion fluctuation rate in an actual device was examined and ignitability was evaluated. FIG. 11 shows the results as a graph.

The flame kernel area according to schlieren evaluation was found as follows. Each spark plug was attached to a compressing chamber, mixed gas of gas and air was filled into the chamber, and ignition was performed. The test condition was as follows: A/F=18; fuel was $C_3H_8$; and initial compression was 0.05 MPa. The flame kernel area was found in 3 ms after the ignition according to a schlieren method.

The ignitability evaluation in an actual device was conducted as follows. A six-cylinder, 2-liter engine was provided as an evaluation engine. The test condition was as follows: number of revolutions 750 rpm; boost pressure 550 mmHg; and A/F=14.5. IMEP (indicated mean effective pressure) was found based on the combustion pressure, and the combustion fluctuation rate was calculated according to the following expression from the average value of 500 samples and the standard deviation. A combustion fluctuation rate of 20% was evaluated as the combustion limit, wherein the combustion fluctuation rate is defined as the standard deviation/average value×100(%).

According to the result, in the spark plugs with the protruding length T of the center electrode leading end portion 130*ss* set to 2.0 mm and 2.5 mm, even when the flame kernel area according to the schlieren evaluation was large, the combustion fluctuation rate largely exceeded 20% of the combustion limit and did not fall below 20%. In the spark plug with the protruding length T of the center electrode leading end portion 130*ss* set to 3.0 mm, when the flame kernel area according to the schlieren evaluation became large, specifically when the flame kernel area exceeded about 90 mm 2, the combustion fluctuation rate fell within 20% of the combustion limit. In the spark plugs with the protruding length T of the center electrode leading end portion 130*ss* set to 3.5 mm and 4.0 mm, when the flame kernel area according to the schlieren evaluation was large, specifically when the flame kernel area exceeded about 70 $mm^2$, the combustion fluctuation rate fell within 20% of the combustion limit.

Thus, when the protruding length T of the center electrode leading end portion 130*ss* is set to 3.5 mm or more, the combustion fluctuation rate particularly decreases, and ignitability improves. Therefore, in the embodiment of the invention, the protruding length T of the center electrode leading end portion 130*ss* is set to 3.5 mm or more.

d. Test 4

Figure 12:
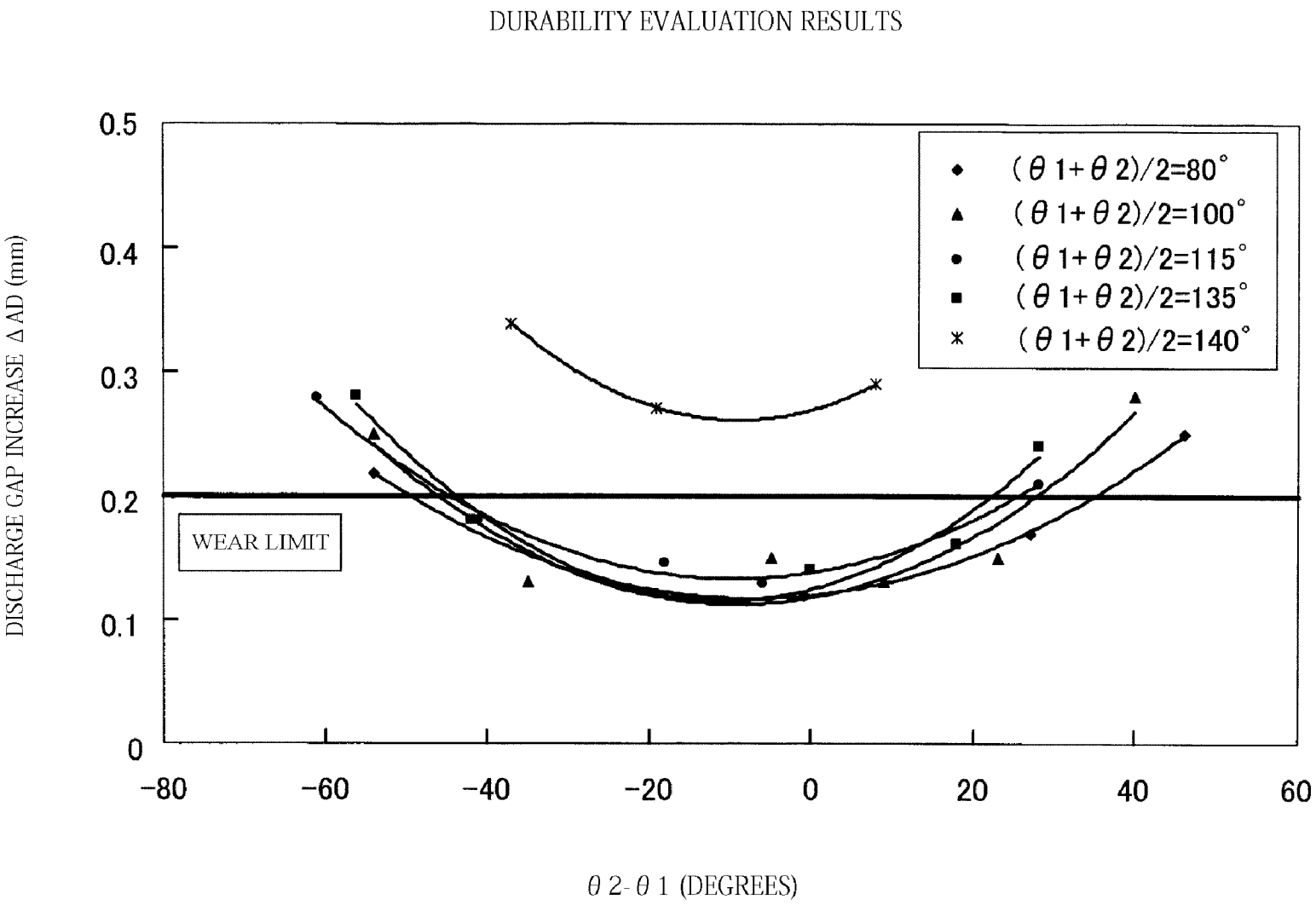
FIG. 12 is a graph showing the increasing amount of a spark discharge gap of spark plugs having different angles θ1 and θ2.

In Test 4, a large number of spark plugs with different angles θ1 and θ2 were provided. For each of the spark plugs, the increasing amount ΔAD of the length AD of the spark discharge gap G produced with use was examined and the durability of the spark plug was evaluated. FIG. 12 shows the results as a graph.

The durability evaluation was conducted as follows: Each spark plug was attached to a compressing chamber. The test condition was as follows: pressure 0.4 MPa; repetitive frequency 100 Hz; in atmosphere; and durability test time 250 hours. The increasing amount of the spark discharge gap G was measured after the termination of the test. The increasing amount 0.2 mm was adopted as the durability limit.

According to the result, in the spark plug satisfying (θ1+θ2)/2=140 degrees, even when the angles θ1 and θ2 were changed in this range and the value of (θ2−θ1) was changed, the increasing amount of the spark discharge gap G largely exceeded 0.2 mm of the durability limit.

In contrast, in the spark plugs satisfying (θ1+θ2)/2=80 degrees, 100 degrees, 115 degrees, and 135 degrees, when the angles θ1 and θ2 were changed and the value of (θ2−θ1) was placed in the range of −40 degrees to 20 degrees, the increasing amount of the spark discharge gap G fell within 0.2 mm of the durability limit.

Thus, the durability of the spark plug is sufficiently enhanced by satisfying the relationships (θ1+θ2)/2≦135 degrees and −40 degrees≦(θ2−θ1)≦20 degrees.

e. Test 5

Figure 13:
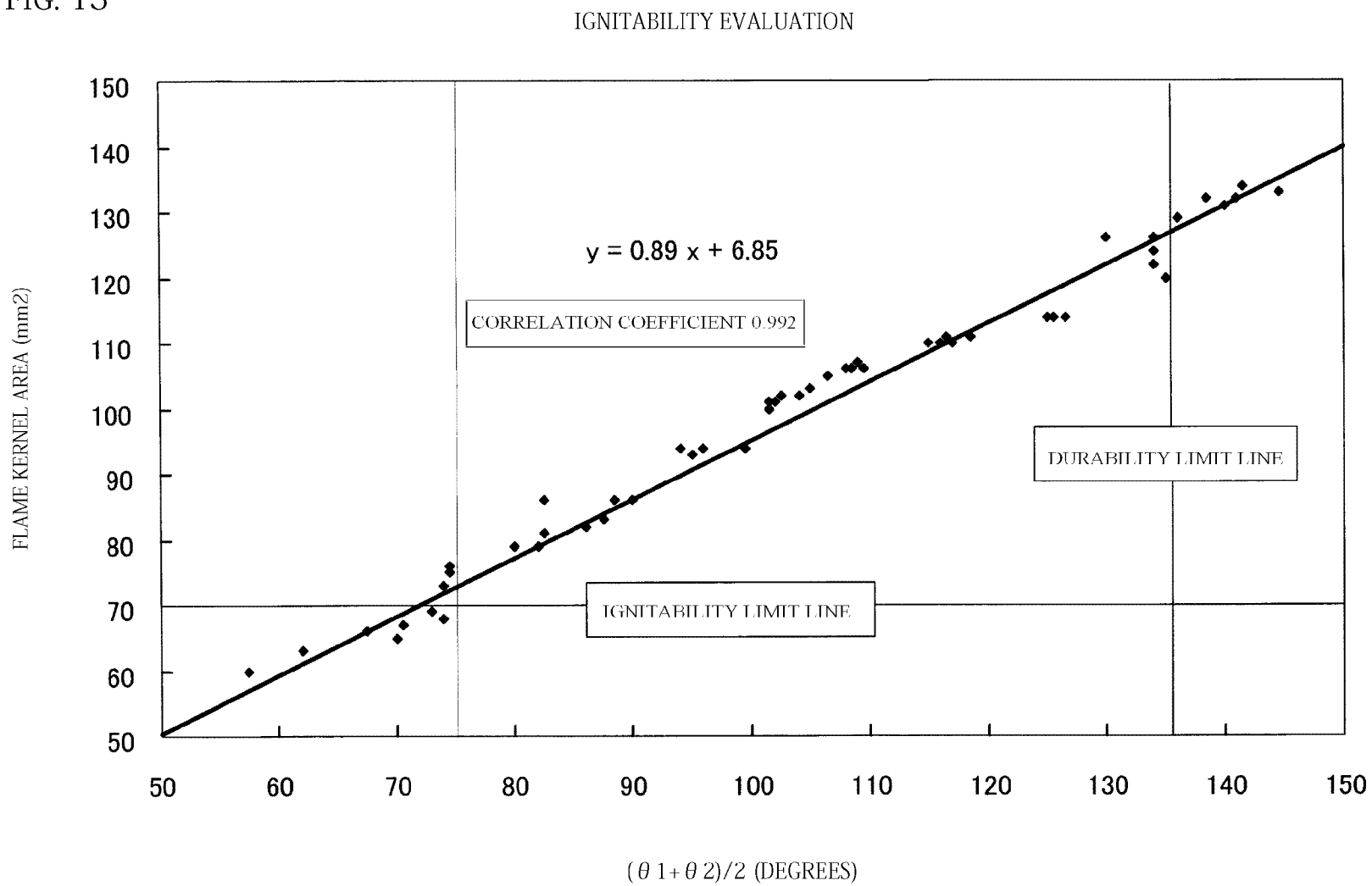
FIG. 13 is a graph showing the flame kernel areas of spark plugs having different angles θ1 and θ2.

In Test 5, a large number of spark plugs with different angles θ1 and θ2 were provided. For each of the spark plugs, the flame kernel area according to schlieren evaluation was examined. Flame kernel area 70 $mm^2$ was adopted as the ignitability limit for evaluation. FIG. 13 shows the results as a graph. Calculation of the flame kernel area according to the schlieren method is as previously described in Test 3.

Consequently, a very high correlation (y=0.89x+6.85, correlation coefficient 0.992) was recognized between (θ1+θ2)/2 and the flame kernel area. When (θ1+θ2)/2 is at least 75 degrees or more, the flame kernel area exceeds 70 $mm^2$ of the ignitability limit. Thus, the ignitability of the spark plug is sufficiently enhanced by satisfying a relationship (θ1+θ2)/2≧75 degrees.

Further, according to Test 4 described above, the durability of the spark plug is sufficiently enhanced in the range (θ1+θ2)/2≦135 degrees and −40 degrees≦(θ2−θ1)≦20 degrees, and thus it can be said that both ignitability and durability can be enhanced at the same time in the range satisfying 75 degrees≦(θ1+θ2)/2≦135 degrees and −40 degrees≦(θ2−θ1)≦20 degrees.

f. Test 6

Figure 14:
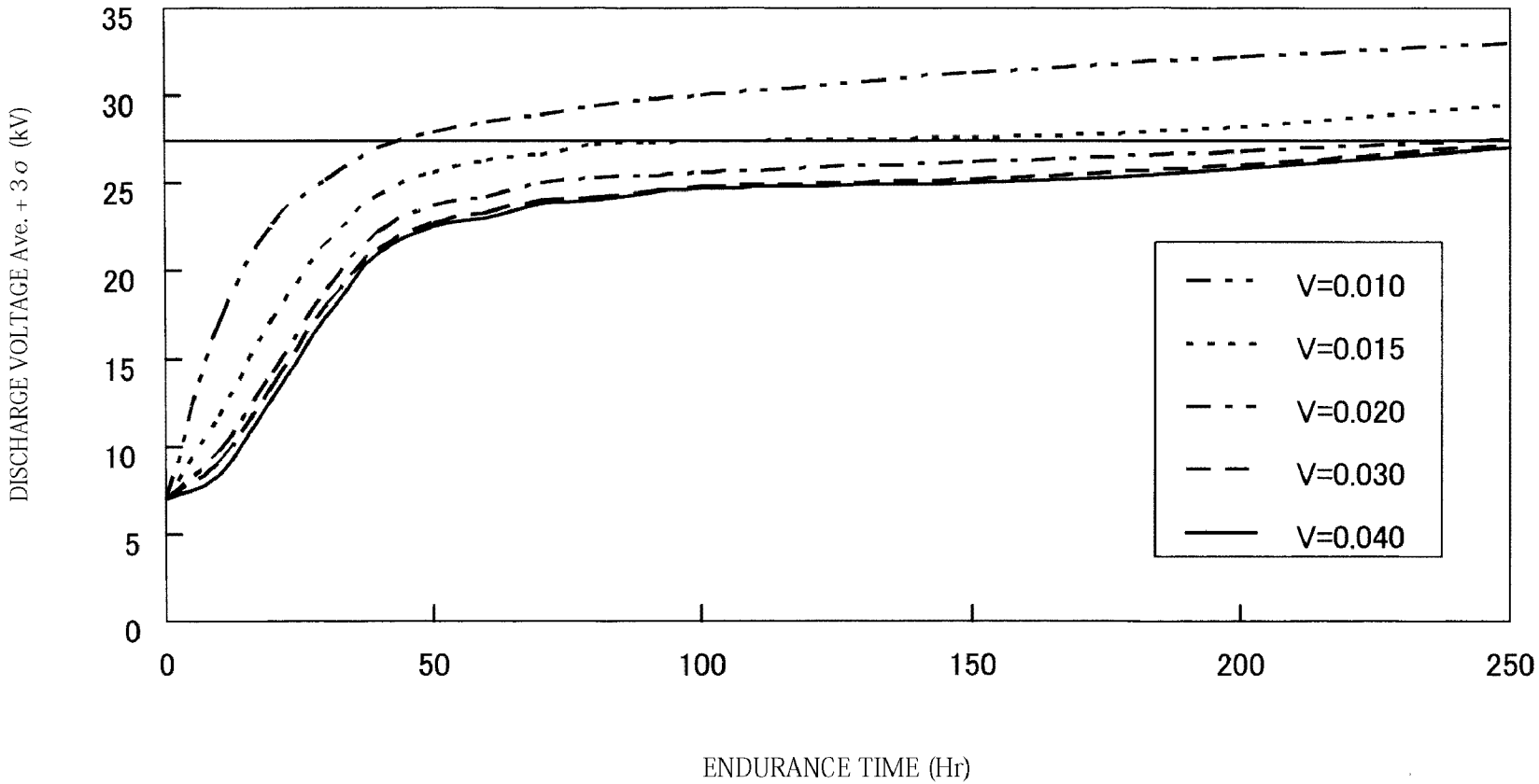
FIG. 14 is a graph showing a relationship between test time and discharge voltage of spark plugs with different volumes V with a spark discharge gap, G, of 0.7 mm.

In Test 6, spark plugs were provided with different total volumes V, each volume V being of the portion 130*ssv* of the center electrode tip 133 and the portion 143*v* of the ground electrode tip 143 which are contained in the imaginary sphere M. Specifically, five types of spark plugs with the length AD of the spark discharge gap G fixed to 0.7 mm and the volume V changed to 0.010 $mm^3$, 0.015 $mm^3$, 0.020 $mm^3$, 0.030 $mm^3$, and 0.040 $mm^3$ were provided. For each of the spark plugs, an increase in discharge voltage was examined and durability was evaluated. FIG. 14 shows the results as a graph.

A discharge voltage increase test was conducted as follows: Each spark plug was attached to a compressing chamber. The test condition was as follows: pressure 0.4 MPa; repetitive frequency 100 Hz; in atmosphere; and discharge voltage of a value resulting from adding three times standard deviation (σ) to an average value (Ave.) of 500 discharge voltage measurement samples.

According to the result, in the spark plug of volume V=0.010 $mm^3$, it took an extremely short time until the discharge voltage became a 20-kV increase (in the example, 27.5 kV) of the initial discharge voltage of the test (in the example, 7.5 kV) after the test started. Also in the spark plug of volume V=0.015 $mm^3$, it is seen that the time until the discharge voltage becomes a 20-kV increase (27.5 kV) of the initial discharge voltage is short.

On the other hand, in the spark plugs of volume V=0.020 $mm^3$, volume V=0.030 $mm^3$, and volume V=0.040 $mm^3$, it took long time, i.e., 2.5 times or more that of the spark plug of volume V=0.015 $mm^3$, until the discharge voltage becomes a 20-kV increase (27.5 kV) of the initial discharge voltage. Thus, the durability of the spark plug is particularly enhanced by setting volume V=0.020 $mm^3$ or more.

g. Test 7

Figure 15:
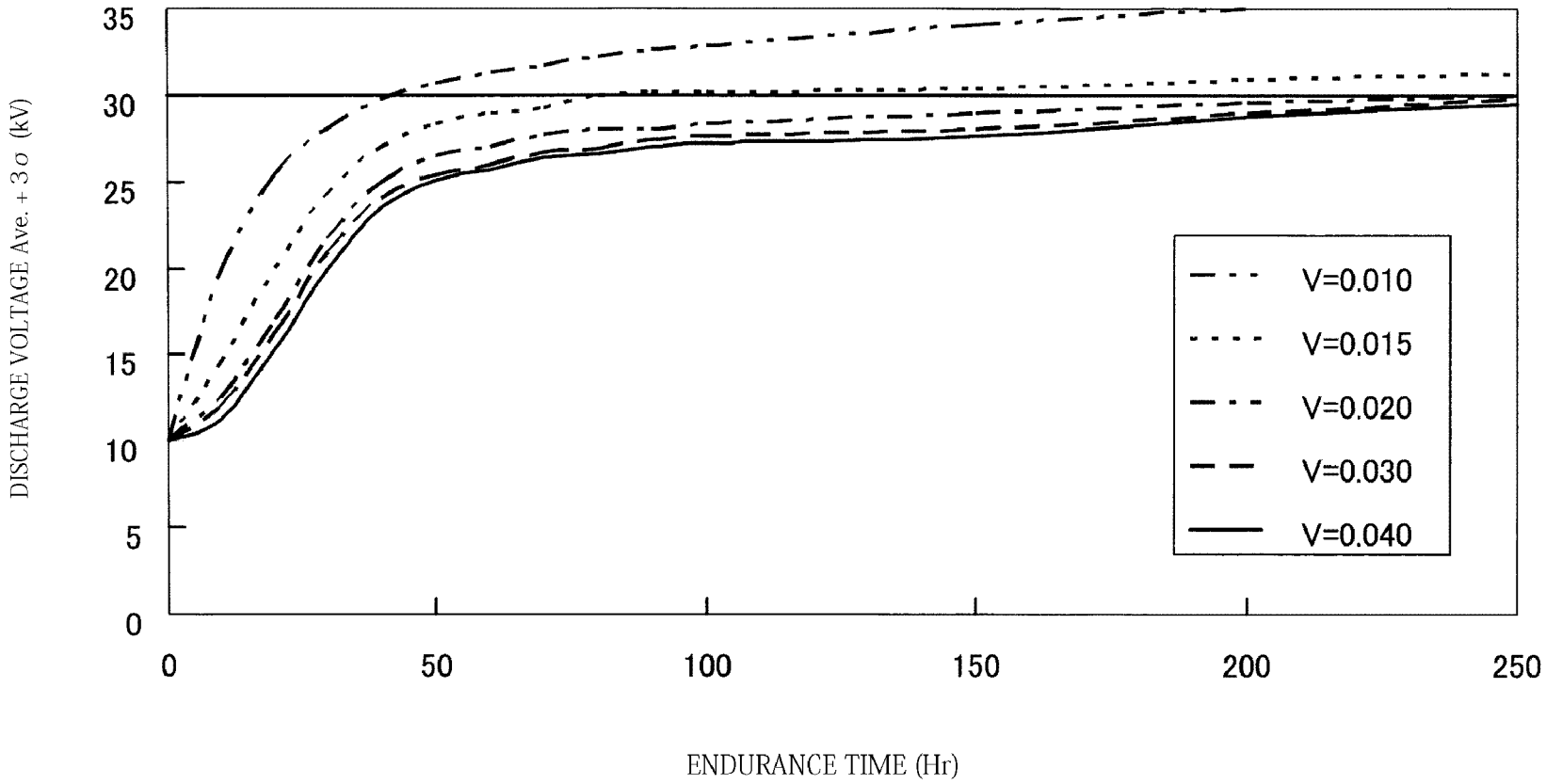
FIG. 15 is a graph showing a relationship between test time and discharge voltage of spark plugs with different volumes V with a spark discharge gap, G, of 0.9 mm.

In Test 7, an evaluation test similar to Test 6 described above was conducted with the length AD of the spark discharge gap G fixed to 0.9 mm. FIG. 15 shows the results as a graph.

According to the result, in the spark plug of voltage V=0.010 $mm^3$, it took an extremely short time until the discharge voltage became a 20-kV increase (in the example, 30 kV) of the initial discharge voltage of the test (in the example, 10 kV) after the test started. Also in the spark plug of volume V=0.015 $mm^3$, the time until the discharge voltage becomes a 20-kV increase (30 kV) of the initial discharge voltage is short.

On the other hand, in the spark plugs of volume V=0.020 $mm^3$, volume V=0.030 $mm^3$, and volume V=0.040 $mm^3$, the time until the discharge voltage becomes a 20-kV increase (i.e., 30 kV) of the initial discharge voltage is long and is 2.5 times or more that of the spark plug of volume V=0.015 $mm^3$. Thus, the durability of the spark plug is particularly enhanced by setting volume V=0.020 $mm^3$ or more.

h. Test 8

Figure 16:
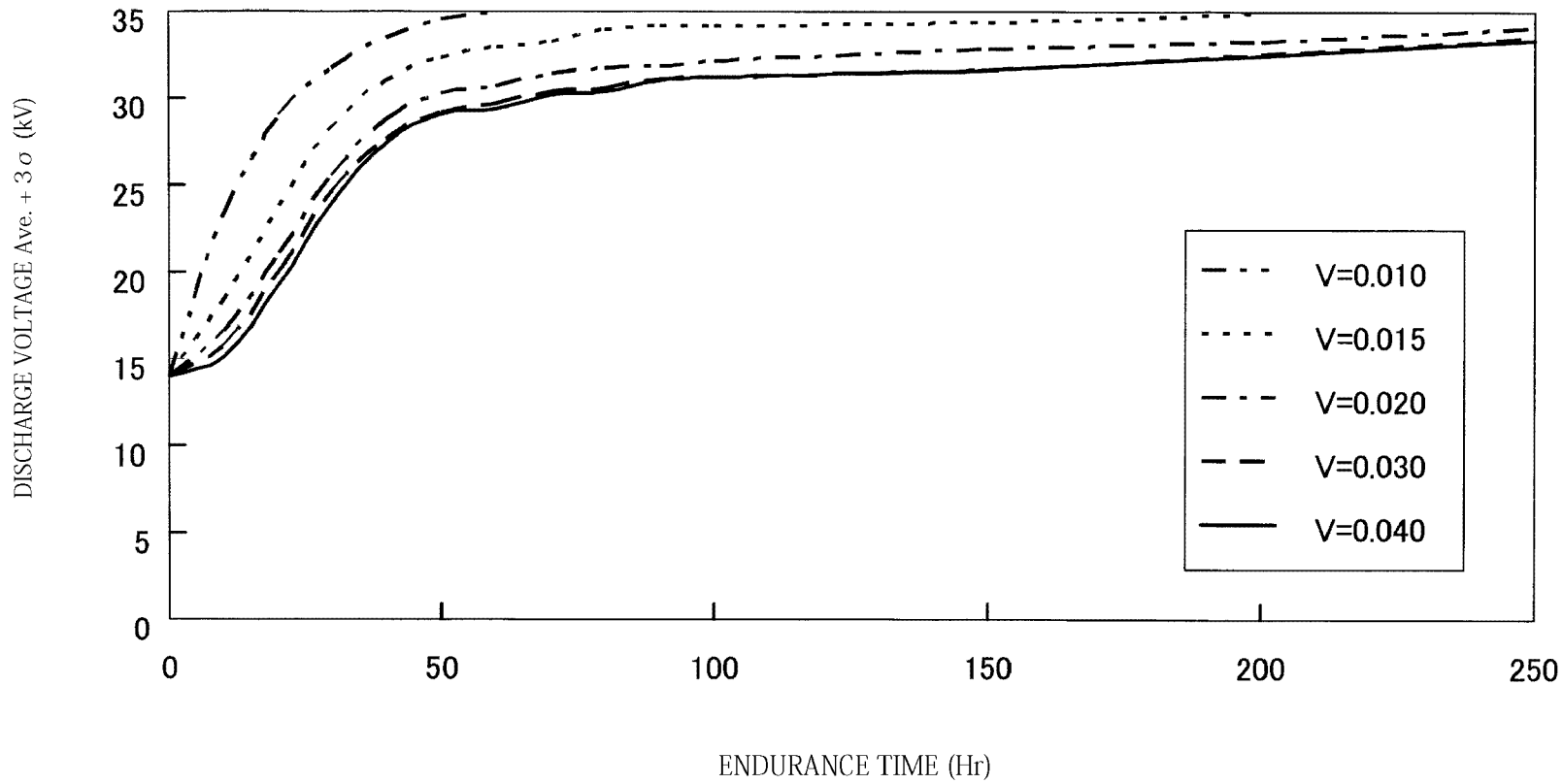
FIG. 16 is a graph showing a relationship between test time and discharge voltage of spark plugs with different volumes V with a spark discharge gap, G, of 1.1 mm.

In Test 8, an evaluation test similar to Tests 6 and 7 described above was conducted with the length AD of the spark discharge gap G fixed to 1.1 mm. FIG. 16 shows the results as a graph.

According to the result, in the spark plug of volume V=0.010 $mm^3$, the time until the discharge voltage became a 20-kV increase (in the example, 35 kV) of the initial discharge voltage of the test (in the example, 15 kV) after the test starts was extremely short. Also in the spark plug of volume V=0.015 $mm^3$, the time until the discharge voltage became a 20-kV increase (i.e., 35 kV) of the initial discharge voltage was short.

On the other hand, in the spark plugs of volume V=0.020 $mm^3$, volume V=0.030 $mm^3$, and volume V=0.040 $mm^3$, the time until the discharge voltage became a 20-kV increase (35 kV) of the initial discharge voltage was long and was 2.5 times or more that of the spark plug of volume V=0.015 $mm^3$. Thus, the durability of the spark plug is particularly enhanced by setting volume V=0.020 $mm^3$ or more.

Figure 17:
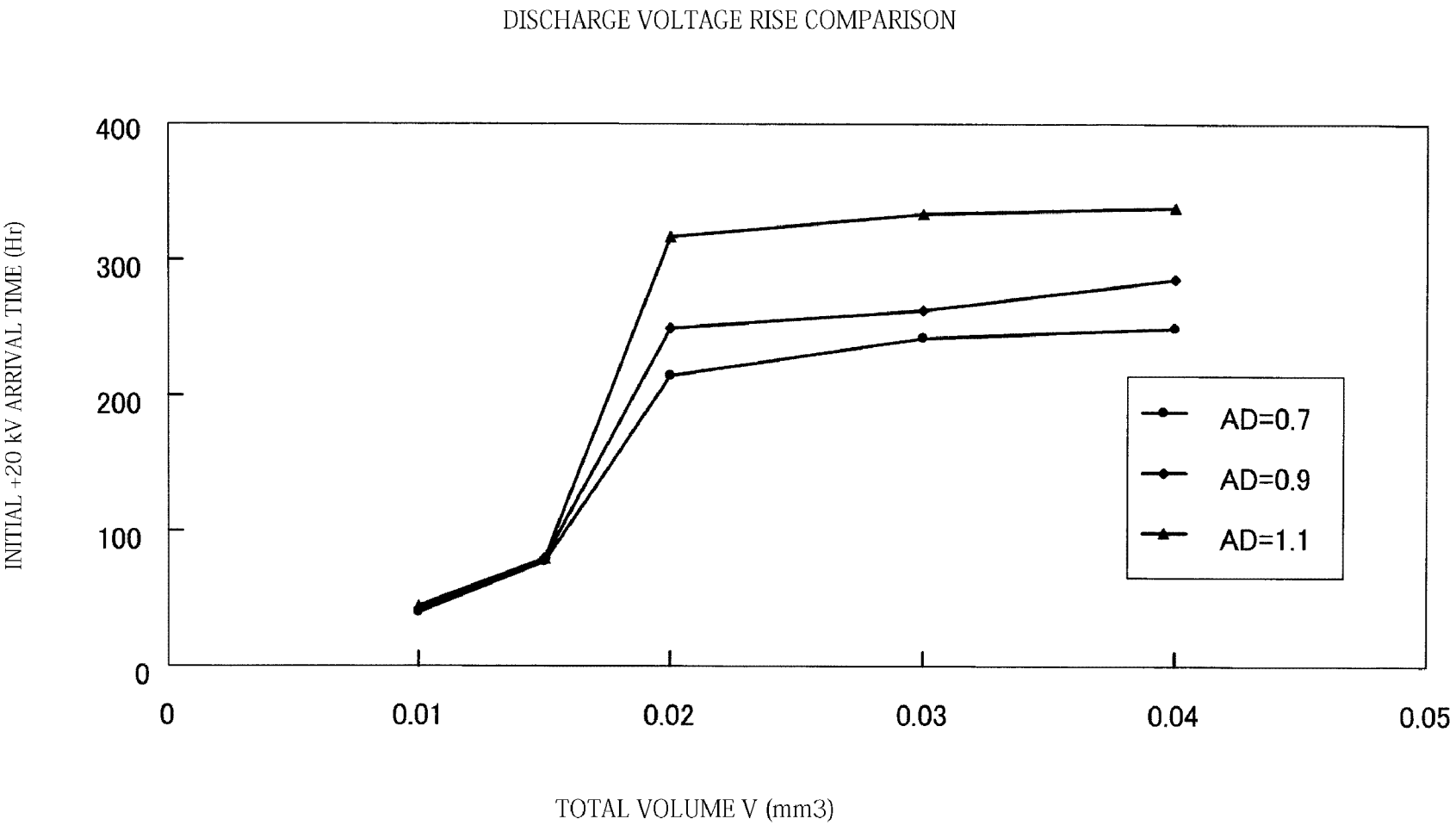
FIG. 17 is a graph showing arrival time until predetermined discharge voltage of spark plugs with different spark discharge gaps and volumes, V.

Next, the relationship between the total volume V, which is of the portion 130*ssv* of the center electrode leading end portion 130*ss* (center electrode tip 133) and the portion 143*v* of the ground electrode 140 (ground electrode tip 143) which are contained in the imaginary sphere M, and the time until the discharge voltage became a 20-kV increase of the initial discharge voltage was summarized based on the results provided in Tests 6 to 8 described above. FIG. 17 shows the results as a graph.

From the results, in the spark plug of volume V=0.010 $mm^3$, the time until the discharge voltage became a 20-kV increase of the initial discharge voltage was extremely short. Also in the spark plug of volume V=0.015 $mm^3$, the time until the discharge voltage became a 20-kV increase of the initial discharge voltage was short.

On the other hand, in the spark plugs of volume V=0.020 $mm^3$, volume V=0.030 $mm^3$, and volume V=0.040 $mm^3$, the time until the discharge voltage became a 20-kV increase of the initial discharge voltage became drastically long. Therefore, it can be said that the durability of the spark plug is particularly enhanced by setting volume V=0.020 $mm^3$ or more.

i. Test 9

Figure 18:
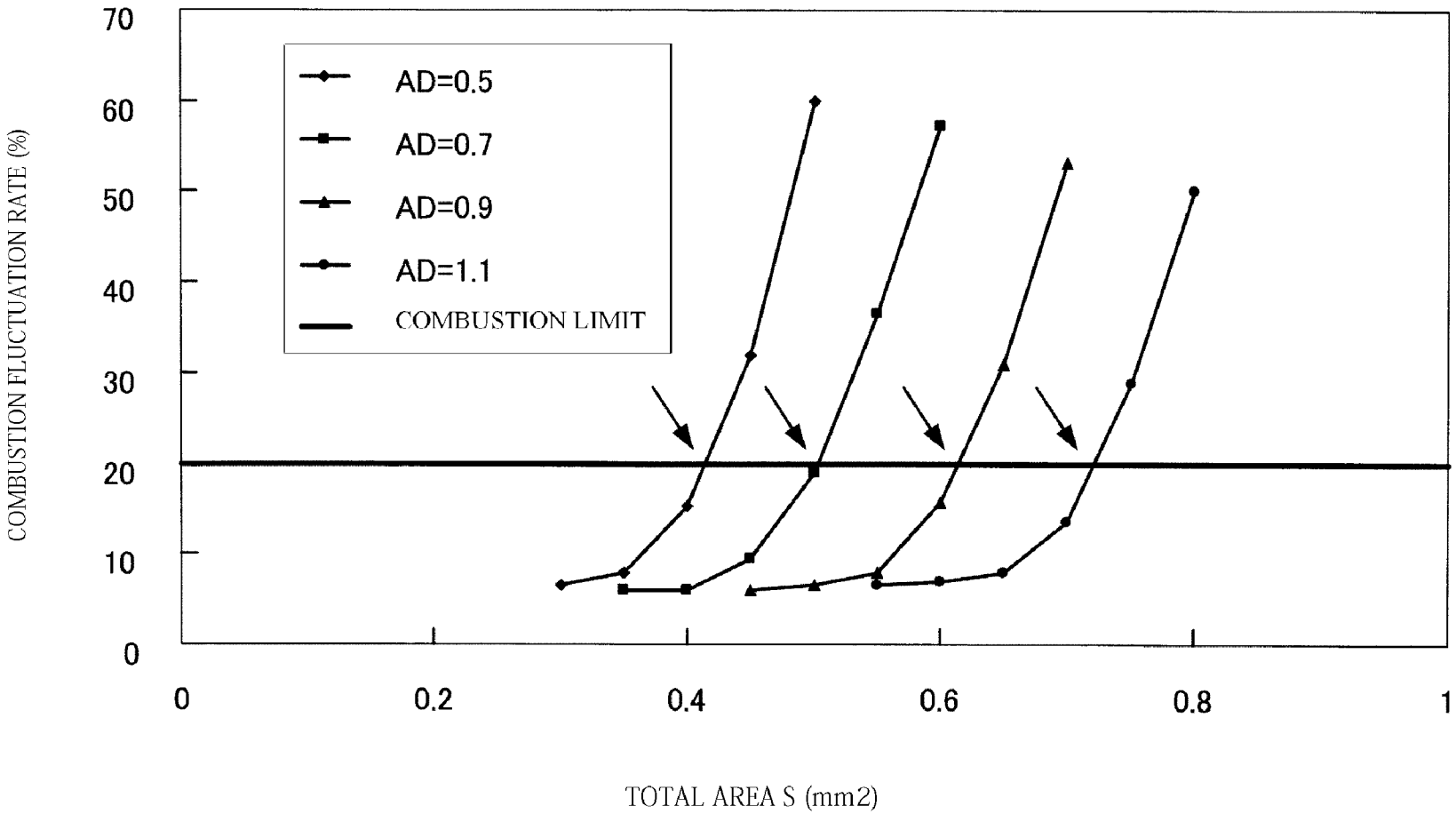
FIG. 18 is a graph showing combustion fluctuation rate of spark plugs with different in spark discharge gaps and areas S.

In Test 9, spark plugs were provided with different total area S of the surface 130*ssvn* of the portion 130*ssv* of the surface of the center electrode leading end portion 130*ss* (center electrode tip 133) and the surface 143*vn* of the portion 143*v* of the ground electrode 140 (ground electrode tip 143) which are contained in the imaginary sphere M. Specifically, a large number of spark plugs with the length AD of the spark discharge gap G changed to 0.5 mm, 0.7 mm, 0.9 mm, and 1.1 mm and the area changed to various sizes were provided. For each of the spark plugs, the combustion fluctuation rate was examined and ignitability was evaluated. The ignitability evaluation is as previously described in Test 3, and the combustion fluctuation rate 20% was evaluated as the combustion limit. FIG. 18 shows the results as a graph.

According to the results, in any length AD of the spark discharge gap G, as the area S increases, the combustion fluctuation rate increases and will exceed 20% of the combustion limit at some future time. The shorter the length AD of the spark discharge gap G, the smaller the area S reaching the combustion limit.

Figure 19:
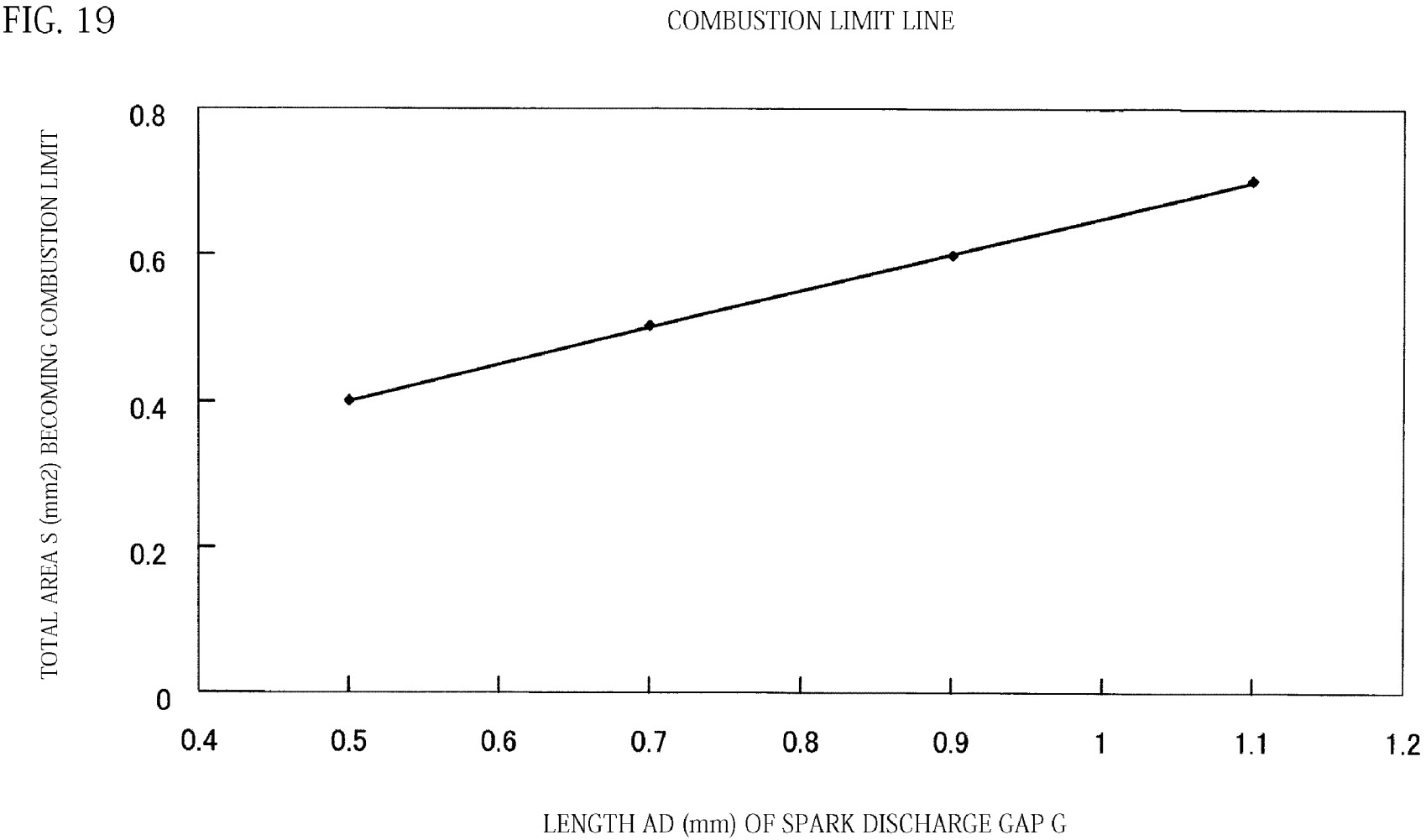
FIG. 19 is a graph showing a relationship between spark discharge gap and area, S, in a combustion limit line.

Further, the total area S just becoming the combustion limit (combustion fluctuation rate 20%) (each total area indicated by the arrow in FIG. 18) in each length AD of the spark discharge gap G was examined based on the result provided in Test 9 described above. FIG. 19 shows the result as a graph.

According to the result, the length AD of the spark discharge gap G and the total area S becoming the combustion limit have the relation of a linear function with a positive inclination. Specifically, their relationship in the combustion limit can be represented by an expression of S=AD/2+0.15 mm. Accordingly, it can be said that ignitability is sufficiently enhanced when the spark plug satisfies the relationship $S \leqq AD/2+0.15$ mm.

j. Test 10

In Test 10, spark plugs with the tip length C of the ground electrode tip 143 changed to various sizes were provided. Specifically, spark plugs with the tip length C set to 0.2 mm, 0.3 mm, 0.4 mm, 0.6 mm, 0.8 mm, 1.2 mm, 1.6 mm, and 2.0 mm were provided. In every spark plug, $(\theta 1+\theta 2)/2=75$ degrees.

Figure 20:
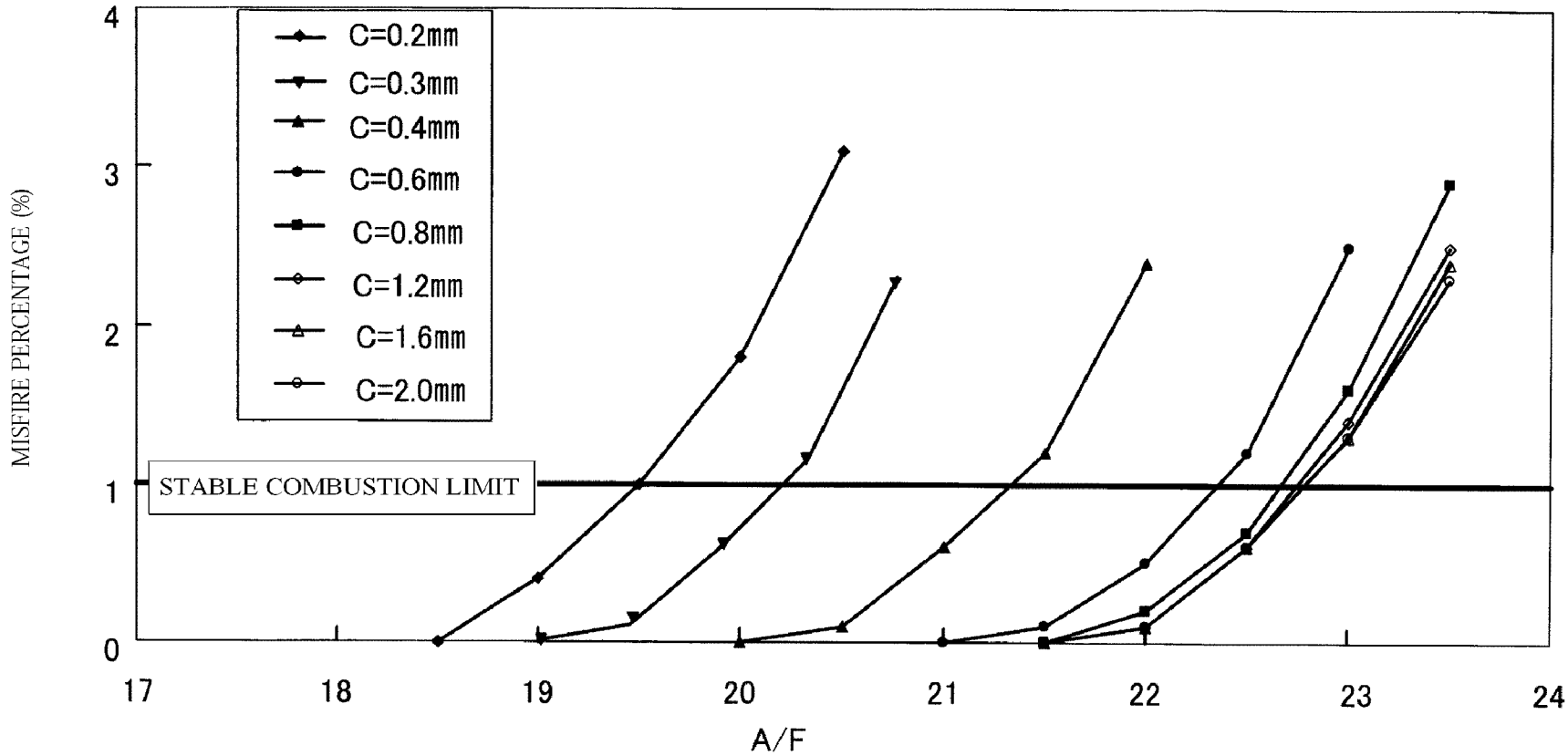
FIG. 20 is a graph showing a relationship between A/F and misfire percentage of spark plugs with different tip lengths of ground electrode tips.

For each of the spark plugs, the relationship between air-fuel ratio (A/F) and misfire percentage was examined. Specifically, each spark plug was placed in an evaluation engine (six-cylinder, 2-liter engine), and the number of revolutions was set to 2000 rpm and the boost pressure was set to 350 mmHg. IMEP (indicated mean effective pressure) was found from the measured combustion pressure and for a value of 50% or less of the average value of combustion pressures of 1000 samples, misfire was assumed to occur and misfire percentage was found. The stable combustion limit was evaluated as misfire percentage 1%. FIG. 20 shows the result as a graph.

According to the result, in the spark plug with the tip length C set to 0.2 mm, when A/F=about 19.5, misfire percentage 1% of the stable combustion limit was reached, and when the value of A/F exceeds about 19.5, the stable combustion limit (misfire percentage 1%) was drastically exceeded.

In contrast, in the spark plugs with the tip length C ranging from 0.3 mm to 2.0 mm, the misfire percentage was also lower than the stable combustion limit (misfire percentage 1%) at least when A/F=20.

In the spark plug with the tip length C set to 0.2 mm, stable combustion cannot be realized unless an air-fuel ratio richer than A/F=19.5 is set. In contrast, in the spark plugs with the tip length C ranging from 0.3 mm to 2.0 mm, stable combustion can be realized even at lean air-fuel ratio of A/F=20. Therefore, to make it possible to perform stable lean combustion, it is preferable that the tip length C of the ground electrode tip 143 is set to 0.3 mm or more.

k. Test 11

In Test 11, spark plugs with the tip length C of the ground electrode tip 143 changed to various sizes were provided as in Test 10 described above. Specifically, spark plugs with the tip length C set to 0.2 mm, 0.4 mm, 0.6 mm, 0.8 mm, 1.2 mm, 1.6 mm, and 2.0 mm were provided. In every spark plug, $(\theta 1+\theta 2)/2=75$ degrees.

Figure 21:
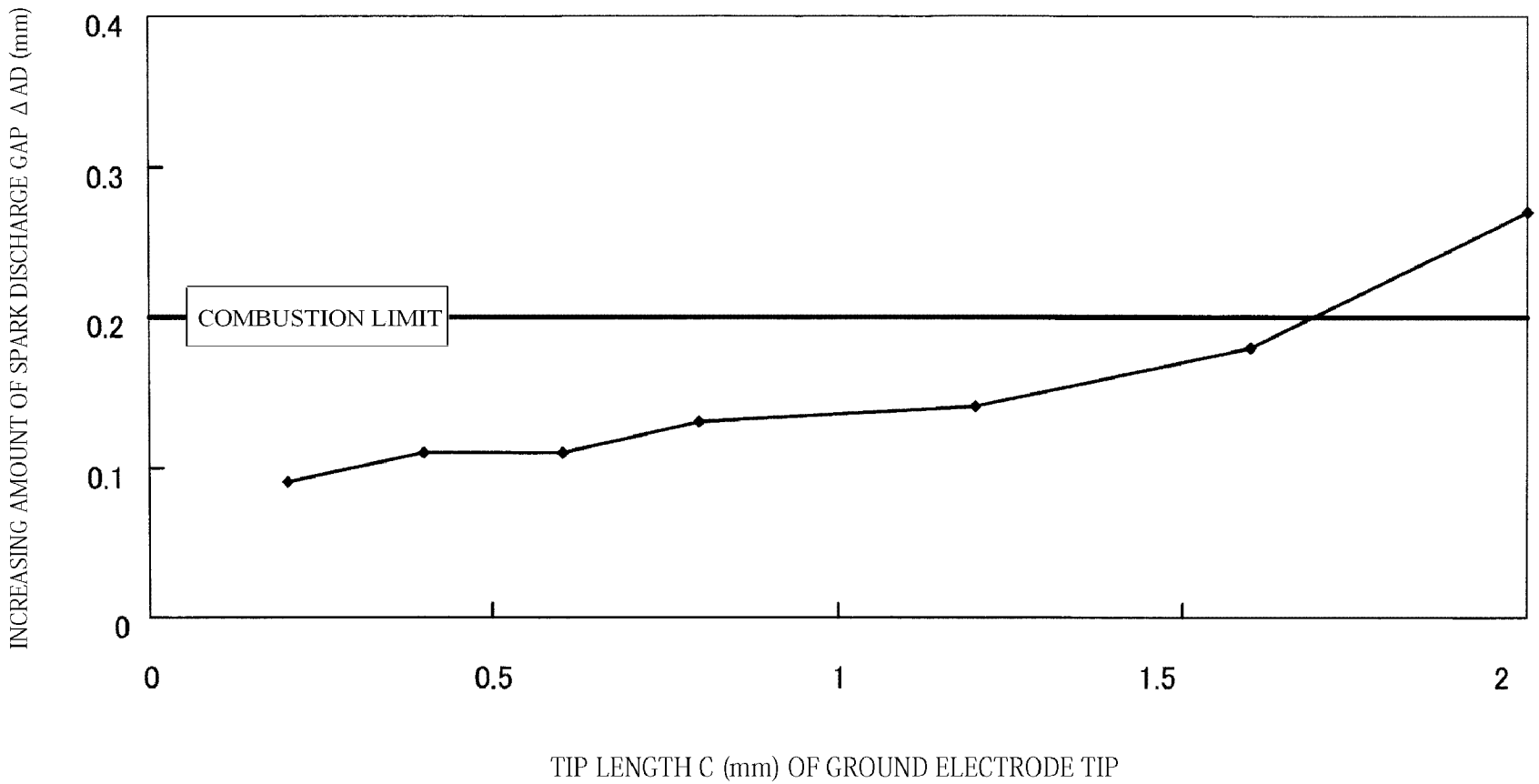
FIG. 21 is a graph showing a relationship between the tip length of a ground electrode tip and the increasing amount of a spark discharge gap.

For each of the spark plugs, the increasing amount ΔAD of the length AD of the spark discharge gap G produced with operation was examined and the durability of the spark plug was evaluated. To examine the increasing amount ΔAD of the spark discharge gap G, each spark plug was placed in an evaluation engine (six-cylinder, 2-liter engine) and test was conducted at the number of revolutions 5000 rpm for 100 hours at WOT (full throttle). The limit (wear limit) of the increasing amount ΔAD of the spark discharge gap G was evaluated as 0.2 mm. FIG. 21 shows the result as a graph.

According to the result, in the spark plug with the tip length C set to 2.0 mm, the increasing amount ΔAD of the spark discharge gap G drastically exceeded the wear limit (0.2 mm). In contrast, in the spark plugs with the tip length C ranging from 0.2 mm to 1.6 mm, the increasing amount ΔAD of the spark discharge gap G fell within the wear limit (0.2 mm). Thus, to enhance the durability of the spark plug, it is preferable that the tip length C of the ground electrode tip 143 is set to 1.6 mm or less. It is understood that the wear amount remarkably increases because sufficient heat dissipation of the ground electrode tip 143 is not performed as the tip length C becomes longer.

Since the tip length C of the ground electrode tip 143 is preferably set to 0.3 mm or more to perform stable lean combustion according to Test 10 described above, it is preferable that the tip length C is placed in the range $0.3\ \text{mm} \leqq C \leqq 1.6\ \text{mm}$.

Figure 22:
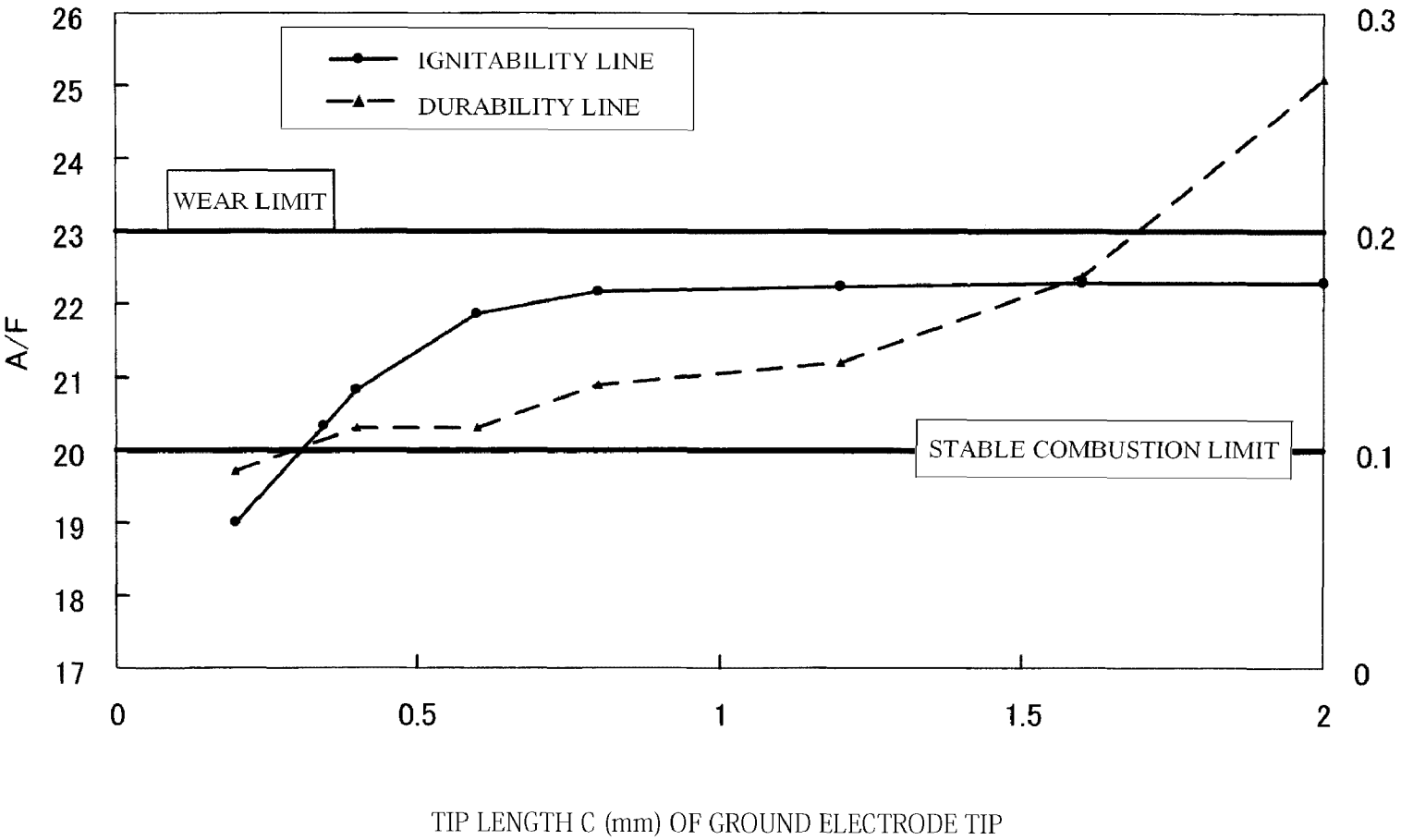
FIG. 22 is a graph showing a relationship between the tip length of a ground electrode tip, A/F, and the increasing amount of a spark discharge gap.

Further, the relationship between the tip length C of the ground electrode tip 143 and ignitability and durability was summarized based on the results provided in Tests 10 and 11. Specifically, the relationship between the tip length C and A/F and the increasing amount of the spark discharge gap G was summarized and ignitability and durability were evaluated. A/F=20 was evaluated as the stable combustion limit. The increasing amount ΔAD of the spark discharge gap G, by 0.2 mm was evaluated as the wear limit. FIG. 22 shows the results as a graph.

From the results, it is possible to enhance ignitability and perform stable lean combustion by setting the tip length C of the ground electrode tip 143 to 0.3 mm or more. The wear amount of the ground electrode tip 143 decreases and durability is enhanced when the tip length C is set to 1.6 mm or less. Therefore, it is preferable that the tip length C of the ground electrode tip 143 is placed in the range $0.3\ \text{mm} \leqq C \leqq 1.6\ \text{mm}$ as described above.

l. Test 12

Figure 23:
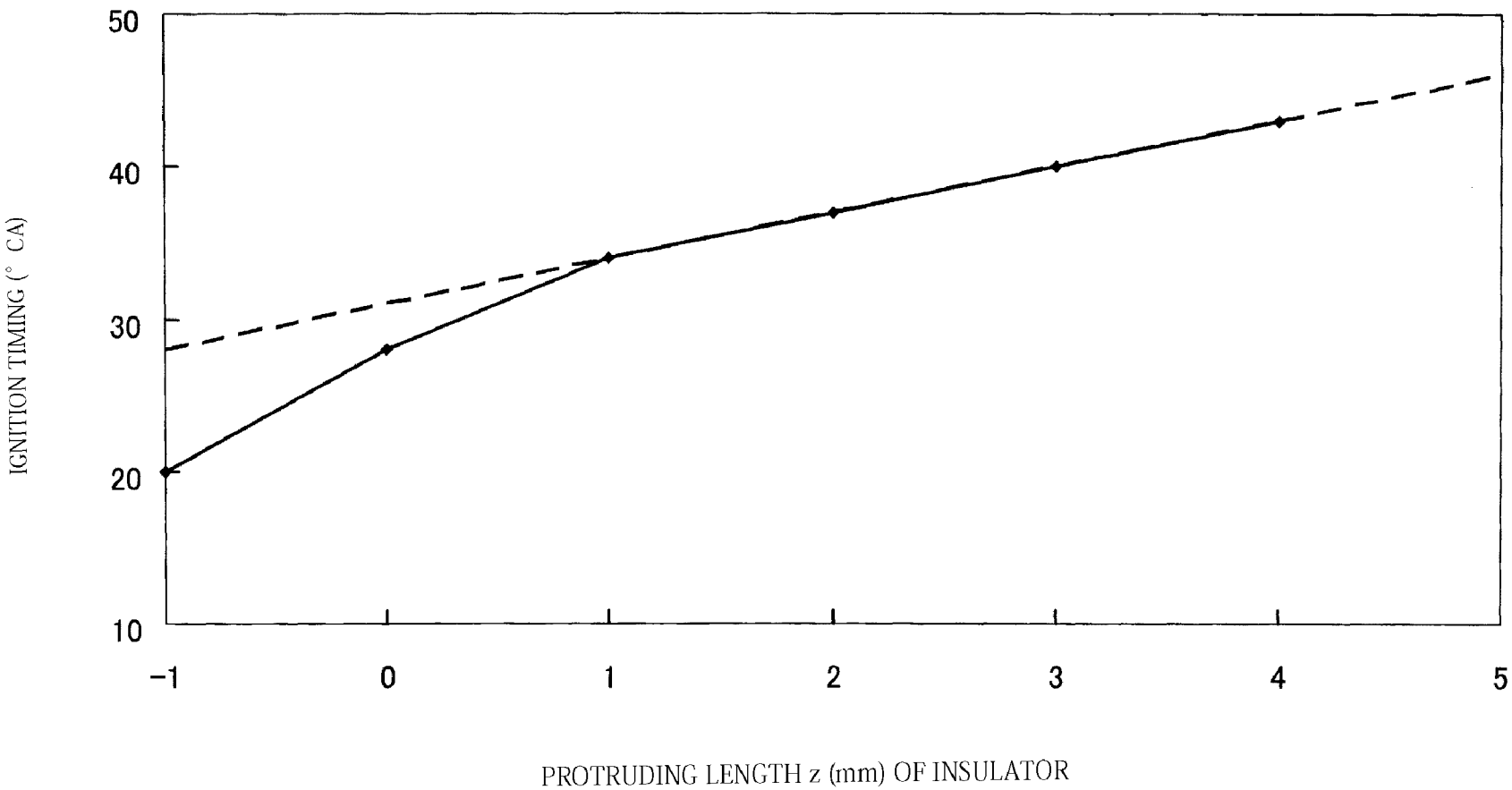
FIG. 23 is a graph showing a relationship between the protruding length of an insulator and an ignition timing of a pre-ignition resistance.

In Test 12, spark plugs with the protruding length Z of the insulator 120 from the metal shell leading end surface 110*sc* changed to various sizes were provided. Specifically, spark plugs with the protruding length Z of the insulator 120 set to −1.0 mm, 0 mm, 1.0 mm, 2.0 mm, 3.0 mm, and 4.0 mm were provided. For each of the spark plugs, pre-ignition resistance test was conducted. Specifically, each spark plug was placed in an evaluation engine (four-cylinder, 6-liter engine) and test was conducted at the number of revolutions 5500 rpm at WOT (full throttle). The ignition timing was advanced and the ignition timing (spark advance) at which pre-ignition occurred four times or more at the time of holding for two minutes at each ignition timing was found. FIG. 23 shows the result as a graph.

According to the result, in the spark plugs with the protruding length Z of the insulator 120 set to 1.0 mm, 2.0 mm, 3.0 mm, and 4.0 mm, the ignition timing became 30° CA or more and the pre-ignition resistance was good. The protruding length Z and the ignition timing have the relationship of a linear function with a positive inclination.

On the other hand, in the spark plugs with the protruding length Z of the insulator 120 set to −1.0 mm and 0 mm, the ignition timing (spark advance) became smaller than the ignition timing predicted from the relationship of the linear function described above (indicated by the dashed line in the figure) and the pre-ignition resistance performance was degraded.

When the protruding length Z of the insulator 120 increases, the cooling effect of fresh air increases and the pre-ignition resistance performance is enhanced. On the other hand, when the protruding length Z of the insulator 120 decreases, particularly when the insulator 120 does not protrude (the protruding length Z is −1.0 mm or 0 mm), it is understood that the cooling effect of fresh air decreases and the pre-ignition resistance performance is degraded. Thus, in the embodiment of the invention, the protruding length Z of the insulator 120 is set to 1.0 mm or more.

m. Test 13

In Test 13, spark plugs with the center electrode tip 133 and the ground electrode tip 143 changed to various materials were provided. Specifically, in a spark plug of sample No. 1, the material of the center electrode tip 133 and the ground electrode tip 143 was Pt-5Ir-5Rh. In a spark plug of sample No. 2, the material of the tips was Pt-10Ir-5Rh. In a spark plug of sample No. 3, the material of the tips was Pt-13Rh. In a spark plug of sample No. 4, the material of the tips was Pt-5Rh. In a spark plug of sample No. 5, the material of the tips was Pt-20Ir. In a spark plug of sample No. 6, the material of the tips was Pt-30Ir. In a spark plug of sample No. 7, the material of the tips was Pt-40Ir. In a spark plug of sample No. 8, the material of the tips was Pt-20Rh. In a spark plug of sample No. 9, the material of the tips was Ir-5Pt-1Rh. In a spark plug of sample No. 10, the material of the tips was Ir-10Rh-10Ru. In a spark plug of sample No. 11, the material of the tips was Ir-11Rh-10Ru. In a spark plug of sample No. 12, the material of the tips was Ir-5Pt.

Figure 24:
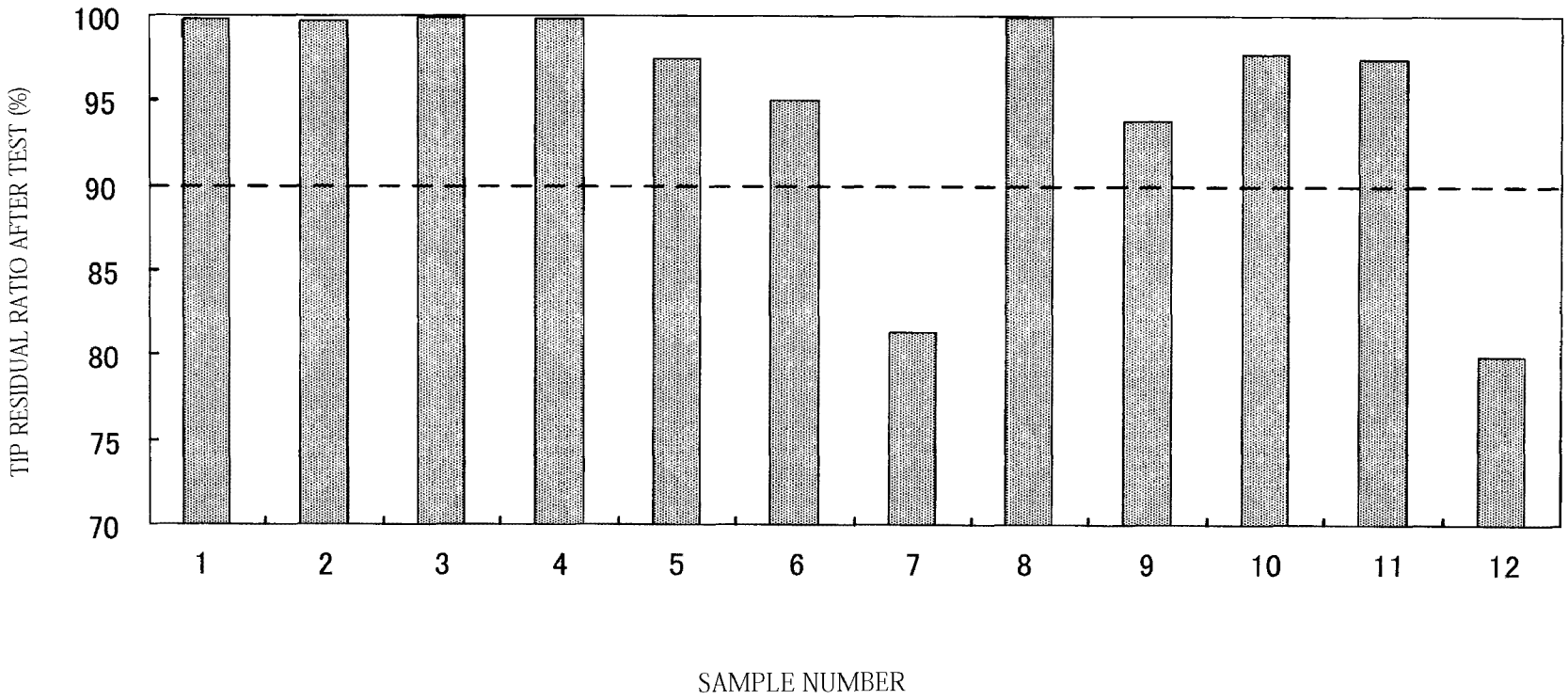
FIG. 24 is a graph showing a tip residual ratio after a test of spark plugs having different materials of center electrode tip and ground electrode tip.

For each of the spark plugs, the tip residual ratio after predetermined test was found and durability was evaluated. Specifically, a constant temperature oven was used as a test device. The test condition was 950° C., 20 hours, and in atmosphere. FIG. 24 shows the result as a graph. Evaluation was conducted with the evaluation criterion as residual ratio 90%.

According to the result, in the spark plug of sample No. 7 with Pt-40Ir, the residual ratio was remarkably lower. In other words, a part of the components contained in the tips were oxidized and volatilized, and the amount of the volatilization was large, which resulted in that the residual amount of the tips became small. In contrast, in the spark plugs of sample Nos. 1 to 6 and 8 containing Pt in an amount of 70 wt % or more, the residual ratio exceeded 90%. Thus, to make the center electrode tip 133 and the ground electrode tip 143 of a Pt alloy, the durability of the spark plug is enhanced by containing Pt in an amount of 70 wt % or more.

In the spark plug of sample No. 12 with Ir-5Pt, the residual ratio was remarkably lower. In contrast, in the spark plugs of sample Nos. 9 to 11 with Rh added to Ir, the residual ratio exceeded 90%. Thus, to make the center electrode tip 133 and the ground electrode tip 143 of an Ir alloy, it is seen that the durability of the spark plug is enhanced by adding Rh.

2. Modified Embodiments 1 to 3

Next, modified embodiments 1 to 3 of the embodiment described above will be discussed. Portions similar to those of the embodiment described above will not be discussed again in detail. Modified embodiments 1 to 3 differ from the above-described embodiment in that ground electrode base members 241, 341, and 441 differ from the ground electrode base member 141 of the embodiment described above.

Figure 25:
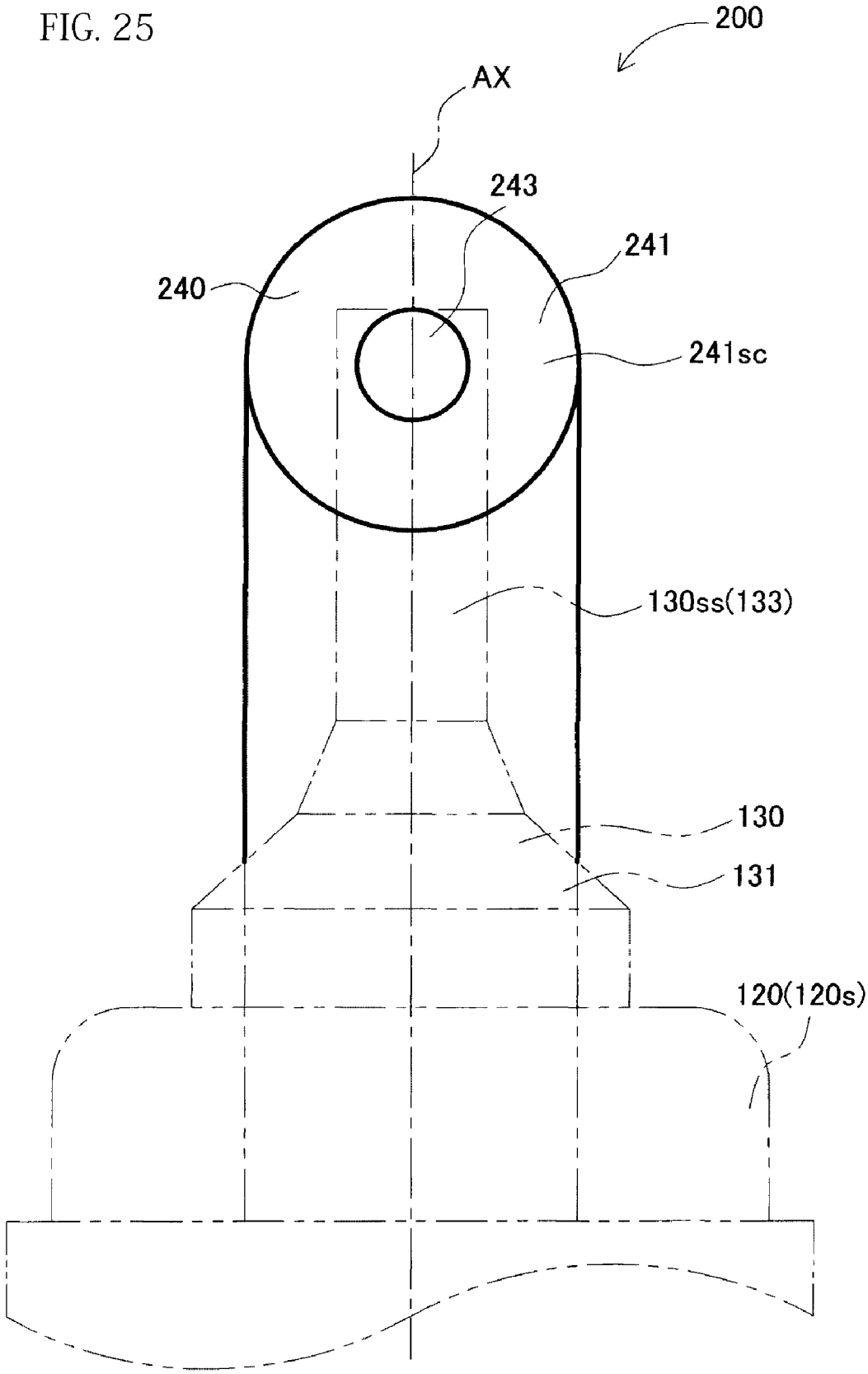
FIG. 25 is a schematic diagram showing a ground electrode of a spark plug according to a first modified embodiment, viewed from the radial inside of the spark plug toward the radial outside of the spark plug.
Figure 26:
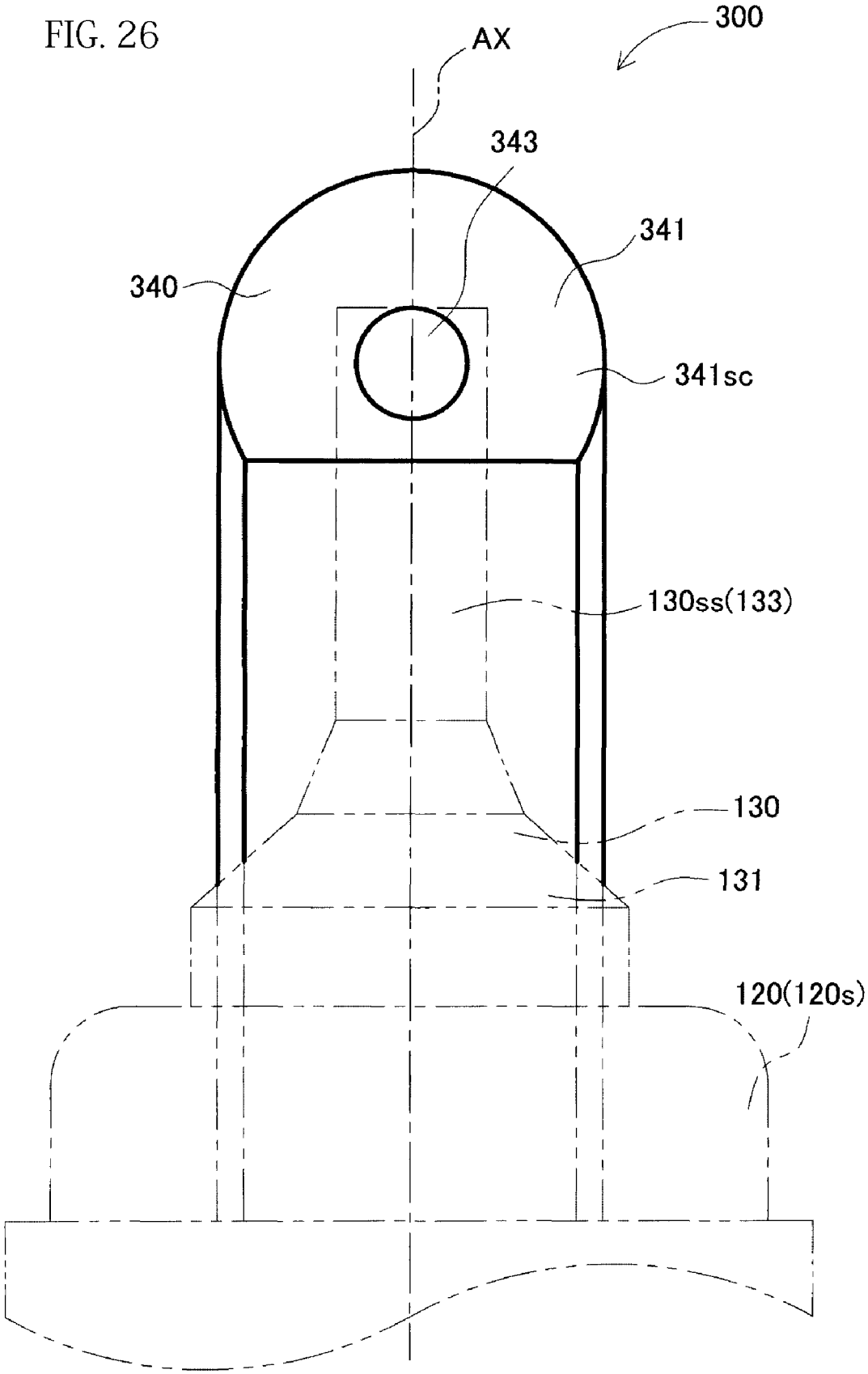
FIG. 26 is a schematic diagram showing a ground electrode of a spark plug according to a second modified embodiment, viewed from the radial inside of the spark plug toward the radial outside of the spark plug.
Figure 27:
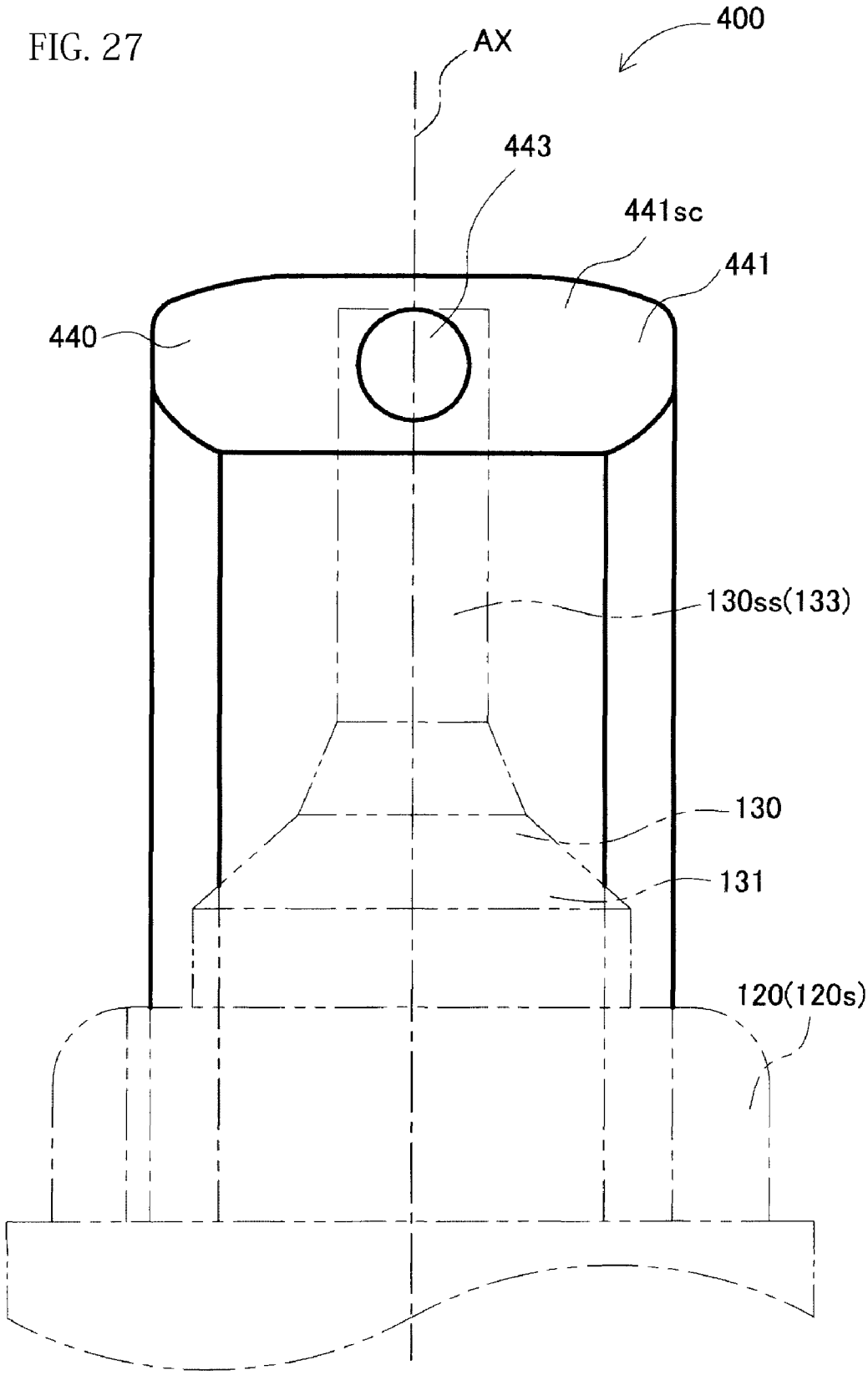
FIG. 27 is a schematic diagram showing a ground electrode of a spark plug according to a third modified embodiment viewed from the radial inside of the spark plug toward the radial outside of the spark plug.

FIG. 25 shows a ground electrode 240 of a spark plug 200 of modified embodiment 1 as viewed from the radial inside toward the radial outside. FIG. 26 shows a ground electrode 340 of a spark plug 300 of modified embodiment 2 as viewed from the radial inside toward the radial outside. FIG. 27 shows a ground electrode 440 of a spark plug 400 of modified embodiment 3 as viewed from the radial inside toward the radial outside.

In the spark plug 200 of modified embodiment 1, as shown in FIG. 25, a base member distal end surface 241*sc* of the ground electrode base member 241 of the ground electrode 240 has a circle shape, and a ground electrode tip 243 is welded to the base member distal end surface 241*sc*.

In the spark plug 300 of modified embodiment 2, as shown in FIG. 26, a base member distal end surface 341*sc* of the ground electrode base member 341 of the ground electrode 340 has a substantially semicircle shape, and a ground electrode tip 343 is welded to the base member distal end surface 341*sc*.

In the spark plug 400 of modified embodiment 3, as shown in FIG. 27, a base member distal end surface 441*sc* of the ground electrode base member 441 of the ground electrode 440 has a rectangular shape with rounded corners, and a ground electrode tip 443 is welded to the base member distal end surface 441*sc*.

Also in the spark plugs 200, 300, and 400 having the ground electrode base members 241, 341, and 441 thus shaped, similar to the spark plug 100 of the above-described embodiment, ignitability can be enhanced while the heat resistance and breakage resistance properties of the ground electrodes 240, 340, and 440 are ensured. In addition, similar portions to those of the embodiment described above produce similar advantages to those of the above-described embodiment.

3. Modified Embodiment 4

Figure 28:
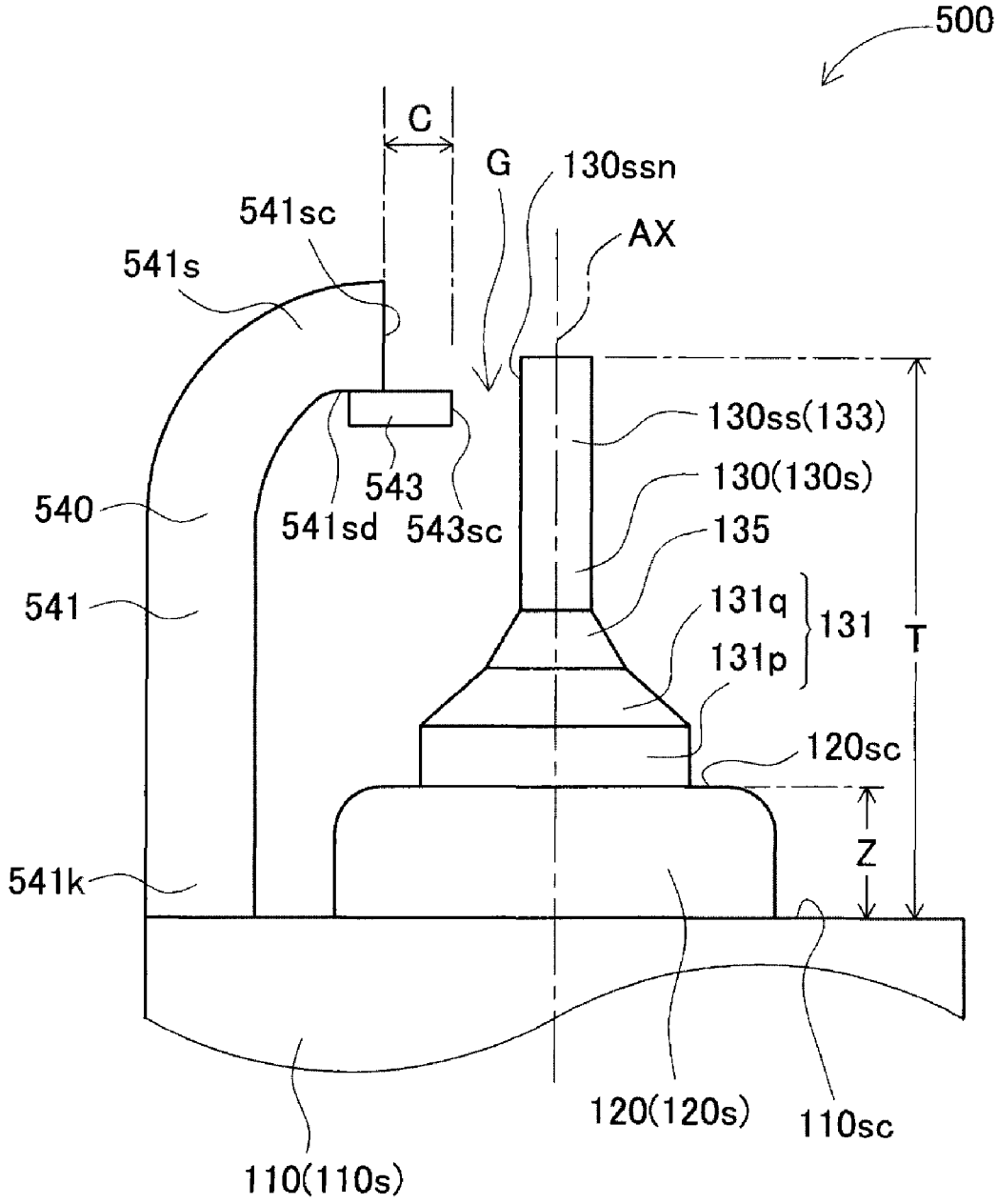
FIG. 28 is a side view showing a center electrode and a ground electrode of a spark plug according to a fourth modified embodiment.

Next, modified embodiment 4 will be described. Portions similar to those of the embodiment and modified embodiments 1 to 3 will not be discussed again in detail. Modified embodiment 4 differs from the embodiment and modified embodiments 1 to 3 in that the joint mode of a ground electrode tip 543 and a ground electrode base member 541 in a ground electrode 540 differs from that in the ground electrode 140, 240, 340, 440 of the embodiment and modified embodiments 1, 2 and 3. FIG. 28 is a side view of a center electrode 130 and the ground electrode 540 of a spark plug 500 according to modified embodiment 4.

The ground electrode 540 of the spark plug 500 according to modified embodiment 4 includes the ground electrode base member 541 as a base member provided by bending a quadrangular prism member; and the prism-shaped ground electrode tip 543 having a width narrower than that of the ground electrode base member 541.

The ground electrode base member 541 includes: a base member base end portion 541*k* joined to a metal shell leading end surface 110*sc*; a base member distal end portion 541*s* bent toward the radial inside; and a base member distal end surface 541*sc* aiming at the radial inside.

The ground electrode tip 543 is joined to a base end side face 541*sd* positioned on the base end side (lower side in FIG. 28), of four side faces forming the periphery of the base member distal end portion 541*s* of the ground electrode base member 541 (four side faces defining the base member distal end surface 541*sc*) by resistance welding. The ground electrode tip 543 protrudes toward the radial inside beyond the base member distal end surface 541*sc* of the ground electrode base member 541. A tip distal end surface 543*sc* of the ground electrode tip 543 is spaced from an outer peripheral surface 130*ssn* of a center electrode leading end portion 130*ss* with a spark discharge gap G for producing spark discharge.

In the spark plug 500 having the ground electrode 540, similar to the spark plugs 100, 200, 300, and 400 of the embodiment and modified embodiments 1 to 3, ignitability can be enhanced while the heat resistance and breakage resistance properties of the ground electrode 540 are ensured. In addition, similar portions to those of the embodiment, etc., described above produce similar advantages to those of the embodiment and modified embodiments.

While the embodiment and modified embodiments 1 to 4 of the invention has been described, it is to be understood that the invention is not limited to the specific embodiment, and changes may be made as required without departing from the spirit and the scope of the invention.

For example, in the above-described embodiments, the spark plug 100 is provided with one ground electrode 140. However, the spark plug may include two or more ground electrodes 140. Incidentally, in the above-described embodiment, the inner area of each of the second circular sectors LT2 and LT3 is defined to contain neither the center electrode leading end portion 130*ss* nor the ground electrode 140. However, when the spark plug includes plurality of ground electrodes, the inner area of each of the second circular sectors LT2 and LT3 drawn based on one ground electrode may contain other electrode(s).

4. Variations and Modifications of Exemplary Embodiments

Although the invention has been described above in relation to exemplary embodiments thereof, it will be understood by those skilled in the art that variations and modifications can be effected in these exemplary embodiments without departing from the scope and spirit of the invention.

What is claimed is:

1. A spark plug comprising:

a cylindrical metal shell having a leading end surface and a base end, and defining an axial direction;

a cylindrical insulator held by the cylindrical metal shell and comprising a leading end surface, a base end, and a protruding insulator portion protruding from the leading end surface of the cylindrical metal shell in the axial direction;

a center electrode held by the insulator and comprising a leading end portion and a protruding center electrode portion protruding from the leading end surface of the cylindrical metal shell in the axial direction, the protruding center electrode portion comprising a center electrode leading end portion being column shaped, extending in the axial direction, and having an outer peripheral surface; and an outer electrode comprising: an outer electrode base member having a base end and a distal end; and a columnar outer electrode tip having a distal end surface, the columnar outer electrode tip being welded to the distal end of the outer electrode base member and being narrower than the outer electrode base member, the distal end surface of the columnar outer electrode tip being spaced from the outer peripheral surface of the center electrode leading end portion to define a spark discharge gap, wherein the protruding insulator portion of the cylindrical insulator protrudes at least 1.0 mm from the leading end surface of the cylindrical metal shell, wherein the protruding center electrode portion of the center electrode protrudes at least 3.5 mm from the leading end surface of the cylindrical metal shell, and wherein a following relationship is satisfied:

$$(\theta 1+\theta 2)/2 \geqq 75 \text{ degrees};$$

wherein, in defining θ1 and θ2:

at least one line segment A connecting the distal end surface of the outer electrode tip and the outer peripheral surface of the center electrode leading end portion at a shortest distance therebetween;

a point A1 is defined as a midpoint of the at least one line segment A;

a line segment B is a collection of the points A1;

a point B1 is defined as a midpoint of the line segment B;

the angle θ1 is defined as a central angle, in degrees, of a first circular sector, and when viewed from a direction perpendicular to the axial direction and also perpendicular to a center axis of the outer electrode tip, the first circular sector includes the point B1 as a center thereof and is defined by two radii and an arc, one of the radii contacting the center electrode leading end portion, the other of the radii contacting the outer electrode, the arc being positioned on a leading end side in the axial direction relative to another arc defined by the two radii, and an inner area of the first circular sector containing neither the center electrode leading end portion nor the outer electrode, and the angle θ2 is an average value, in degrees, of the central angles of two second circular sectors, and when viewed from the leading end side toward a base end side in the axial direction, each of the second circular sectors includes the point B1 as a center thereof and is defined by two further radii and a further arc, one of the further radii contacting the center electrode leading end portion, the other of the further radii contacting the outer electrode, and an inner area of each of the second circular sectors containing neither the center electrode leading end portion nor the outer electrode.

2. The spark plug according to claim 1, wherein:

$(\theta 1+\theta 2)/2 \leqq 135$ degrees; and $-40 \text{ degrees} \leqq (\theta 2-\theta 1) \leqq 20$ degrees.

3. The spark plug according to claim 1, wherein:

$V \geqq 0.020 \text{ mm}^3$ where V is a total volume, in $\text{mm}^3$, of a portion of the center electrode leading end portion and a portion of the outer electrode which are contained in an imaginary sphere, the imaginary sphere having the point B1 as a center thereof with a radius AD/2+0.1 mm, where AD is defined as a length, in mm, of the at least one line segment A.

4. The spark plug according to claim 3, wherein:

$S \leqq AD/2+0.15 \text{ mm}^2$ where S is defined as a total surface area, in $\text{mm}^2$, of a portion of a surface of the center electrode leading end portion and a portion of a surface of the outer electrode which are contained in the imaginary sphere.

5. The spark plug according to claim 1, wherein:

$0.3 \text{ mm} \leqq C \leqq 1.6 \text{ mm}$ where C is defined as a tip length, in mm, of the columnar outer electrode tip from a distal end surface of the outer electrode base member to the distal end surface of the outer electrode tip.

6. The spark plug according to claim 1, wherein the center electrode further comprises: a center electrode base member; and a columnar center electrode tip having a diameter smaller than that of the center electrode base member and welded to the center electrode base member, the center electrode tip defining the center electrode leading end portion.

7. The spark plug according to claim 6, wherein each of the outer electrode tip and the center electrode tip comprises a Pt alloy containing Pt in an amount of at least 70 wt %.

8. The spark plug according to claim 6, wherein each of the outer electrode tip and the center electrode tip comprises an Ir alloy containing Ir and Rh.

* * * * *